US009840946B2

(12) United States Patent
Kanaya et al.

(10) Patent No.: US 9,840,946 B2
(45) Date of Patent: Dec. 12, 2017

(54) VARIABLE VALVE TIMING CONTROL DEVICE OF INTERNAL COMBUSTION ENGINE

(71) Applicant: DENSO CORPORATION, Kariya, Aichi-pref. (JP)

(72) Inventors: Tomohiro Kanaya, Kariya (JP); Yasuhiro Hamaoka, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/111,022

(22) PCT Filed: Jan. 14, 2015

(86) PCT No.: PCT/JP2015/000125
§ 371 (c)(1),
(2) Date: Jul. 12, 2016

(87) PCT Pub. No.: WO2015/111388
PCT Pub. Date: Jul. 30, 2015

(65) Prior Publication Data

US 2016/0376944 A1 Dec. 29, 2016

(30) Foreign Application Priority Data

Jan. 27, 2014 (JP) ..... 2014-12274

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/3443* (2013.01); *F01L 2001/34453* (2013.01); *F01L 2001/34463* (2013.01); *F01L 2201/00* (2013.01); *F01L 2820/044* (2013.01)

(58) Field of Classification Search
CPC ..... F01L 1/3442; F01L 1/047; F01L 2001/34453; F01L 2001/00; F01L 2001/3443; F01L 2001/34463; F01L 2201/00; F01L 2820/044
USPC ..... 123/90.15, 90.17
See application file for complete search history.

(56) References Cited

U.S. PATENT DOCUMENTS

2010/0139593 A1 6/2010 Takemura
2010/0269772 A1 10/2010 Takemura et al.
2011/0214634 A1* 9/2011 Yamaguchi ..... F01L 1/34 123/90.17
2012/0186547 A1 7/2012 Fujiyoshi et al.

* cited by examiner

*Primary Examiner* — Zelalem Eshete
(74) *Attorney, Agent, or Firm* — Nixon & Vanderhye P.C.

(57) ABSTRACT

A variable valve timing control device has, as control modes for adjusting inflow and outflow of oil with an OCV, a lock mode for moving a lock pin in a locking direction, a phase control mode for controlling a camshaft phase by a target phase in accordance with an operation state of an engine, and an oil filling mode for filling an advancement chamber and a retardation chamber with the oil in a state that the lock pin moves in the locking direction, before shifting from the lock mode to the phase control mode. When the oil filling mode has been selected, a target position of a spool is set based on viscosity of the oil, and the position of the spool is controlled so as to be the set target position.

9 Claims, 16 Drawing Sheets

VARIABLE VALVE TIMING CONTROL DEVICE OF INTERNAL COMBUSTION ENGINE

CROSS REFERENCE TO RELATED APPLICATION

This application is the U.S. national phase of International Application No. PCT/JP2015/000125 filed 14 Jan. 2015, which designated the U.S. and claims priority to Japanese Patent Application No. 2014-12274 filed on Jan. 27, 2014, the entire contents of each of which are hereby incorporated herein by reference.

TECHNICAL FIELD

The present disclosure relates to a variable valve timing control device of an internal combustion engine, and specifically relates to a variable valve timing control device of an internal combustion engine, which changes valve timing by a hydraulic drive.

BACKGROUND ART

As an internal combustion engine to be mounted in a vehicle, there has hitherto been known an internal combustion engine including a hydraulic-drive valve timing adjustment device for changing valve timing for intake and exhaust valves, and a lock mechanism for holding a rotation phase of a camshaft in an intermediate lock phase between the most advanced phase and the most retarded phase by means of a lock pin. Further, it has been proposed that in such a system, the internal combustion engine is started in the intermediate lock phase, and a shift then is made to a phase feedback control mode for controlling the rotation phase of the camshaft by a target phase in accordance with an operation state of the internal combustion engine (e.g., see Patent Literature 1). Patent Literature 1 discloses that an oil filling mode for filling an advancement chamber and a retardation chamber with hydraulic oil is performed before the shift to the phase feedback control mode. Further, Patent Literature 1 discloses that one oil control valve (OCV) performs an appropriate switch to any of a lock mode, the oil filling mode, and the phase feedback control mode, thereby adjusting inflow and outflow of the hydraulic oil to and from the valve timing adjustment device and the lock mechanism.

In order to promptly make a shift to the phase feedback control mode after starting of the internal combustion engine, it is desirable to quickly complete oil filling of the advancement chamber and the retardation chamber. It is thus considered that, in the oil filling mode, a spool position is moved to a region where a large amount of the hydraulic oil is supplied to the advancement chamber and the retardation chamber, and then oil filling is performed. Meanwhile, oil leakage may be apt to occur inside the oil control valve depending on a state of the hydraulic oil, and the oil leakage inside the valve may cause the hydraulic oil to flow into a portion originally to be blocked from inflow of the hydraulic oil, resulting in generation of a concern about erroneous release of the lock pin.

PRIOR ART LITERATURE

Patent Literature

[Patent Literature 1] JP 2010-255499-A

SUMMARY OF INVENTION

The present disclosure has been made in view of the above, and it is a principal object of the present disclosure to provide a variable valve timing control device of an internal combustion engine, which is capable of reducing time required for oil filling of an advancement chamber and a retardation chamber while avoiding erroneous release of a lock pin.

The present disclosure relates to a variable valve timing control device, which is a valve timing adjustment device for changing a rotation phase of a camshaft with respect to a crank shaft by adjustment of inflow and outflow of hydraulic oil to and from an advancement chamber and a retardation chamber, to adjust valve timing, the device including: a lock pin that moves by adjustment of inflow and outflow of the hydraulic oil to and from an oil pressure chamber, to lock the rotation phase in an intermediate phase between the most advanced phase and the most retarded phase; and an oil pressure adjustment valve for adjusting inflow and outflow of the hydraulic oil to and from the advancement chamber, the retardation chamber, and the oil pressure chamber by reciprocation of a spool in a shaft direction.

According to one aspect of the present disclosure, the lock pin moves in a lock releasing direction by inflow of the hydraulic oil to the oil pressure chamber, and moves in a locking direction by outflow of the hydraulic oil from the oil pressure chamber. A first region, a second region and a third region are aligned in this order in the shaft direction of the spool as regions in which the spool moves. Control modes for adjusting inflow and outflow of the hydraulic oil by the oil pressure adjustment valve include a lock mode for setting a target position of the spool within the first region to move the lock pin in the locking direction, a phase control mode for setting the target position within the third region to control the rotation phase by a target phase in accordance with an operation state of the internal combustion engine, and an oil filling mode for setting the target position within the second region before shifting from the lock mode to the phase control mode, to fill the advancement chamber and the retardation chamber with the hydraulic oil in a state that the lock pin remains in the moved state in the locking direction. A mode selection device selects any of these control modes. When the oil filling mode has been selected, a position control device sets the target position based on viscosity of the hydraulic oil, and controls a position of the spool so as to be the set target position.

In a configuration where the internal combustion engine is started in the intermediate phase and a shift is made to the phase control mode after starting of the internal combustion engine, the oil filling mode for filling the advancement chamber and the retardation chamber with the hydraulic oil is performed with the locked state remaining in the intermediate phase prior to the phase control mode. In such a system, it is desirable to quickly fill the advancement chamber and the retardation chamber with the hydraulic oil and promptly make a shift to the phase control mode. In order to do so, it is desirable to control the spool position in a place where an amount of the hydraulic oil supplied to the advancement chamber and the retardation chamber is as large as possible.

The possibility for leakage of the hydraulic oil inside the oil pressure adjustment valve varies in accordance with the state of the hydraulic oil, and for example, when a temperature is high, the viscosity of the hydraulic oil is low and the hydraulic oil is apt to be leaked from a gap on the sliding surface of the spool. In that case, it is assumed that the hydraulic oil gets into a space originally to be blocked from inflow of the hydraulic oil. For example, in the oil filling mode, it is necessary to fill the advancement chamber and the retardation chamber with the hydraulic oil in the state the lock pin remains in the moved state in the locking direction, but it is considered that the hydraulic oil may unintentionally get into an oil pressure chamber for lock release depending on the state of the hydraulic oil and the lock pin may be erroneously released. However, a spool position where the amount of the hydraulic oil supplied to the advancement chamber and the retardation chamber is large does not necessarily agree with a spool position where a concern about erroneous release of the lock pin is small, and when the amount of the hydraulic oil supplied to the advancement chamber and the retardation chamber is to be increased, the concern about erroneous release of the lock pin may increase. Conversely, when the concern about erroneous release of the lock pin is to be decreased, the amount of the hydraulic oil supplied to the advancement chamber and the retardation chamber may decrease.

Therefore in the above configuration, in the oil filling mode, a target position of the spool is set based on the viscosity of the hydraulic oil, and the spool position is controlled so as to be the set target position. With this configuration, it is possible to dispose the spool in a position in which erroneous release of the lock pin hardly occurs and which is suitable for oil filling. Hence it is possible to reduce the time required for oil filling of the advancement chamber and the retardation chamber, while avoiding erroneous release of the lock pin.

BRIEF DESCRIPTION OF DRAWINGS

The above object and other objects, characteristics and advantages of the present disclosure will be made clear by the following detailed descriptions with reference to the attached drawings.

EMBODIMENTS FOR CARRYING OUT INVENTION

First Embodiment

Figure 1:
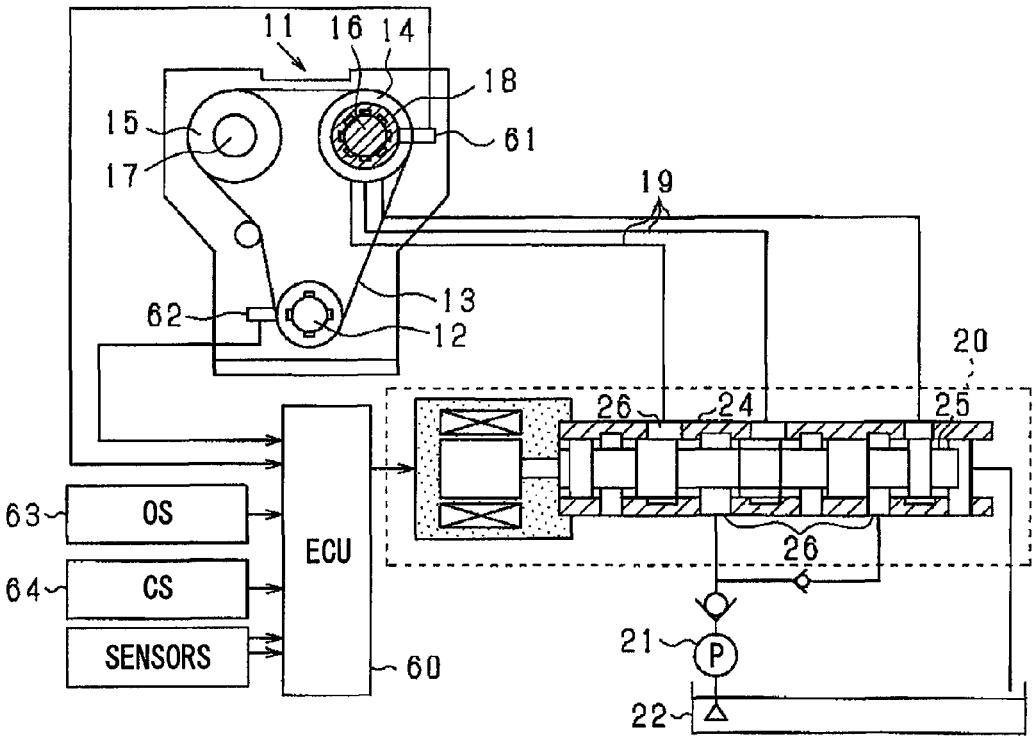
FIG. 1 is a configuration diagram showing an overall outline of a valve timing control system.

Hereinafter, a first embodiment will be described with reference to the drawings. The present embodiment is to construct a valve timing control system with an intake valve of an engine that is an internal combustion engine as a target. In the control system, an electronic control unit (hereinafter referred to as ECU) mainly performs valve timing control. FIG. 1 shows an overall schematic configuration diagram of this control system.

In an engine 11, a crank shaft 12 which is an output shaft of the engine 11 is coupled to a sprocket 14 of an intake-side camshaft 16 and a sprocket 15 of an exhaust-side camshaft 17 via a timing chain (or timing belt) 13. Accordingly, power of the engine 11 is transmitted to the intake-side camshaft 16 and the exhaust-side camshaft 17 via the timing chain 13 and the sprockets 14, 15. When the crank shaft 12 is rotated by a drive of the engine 11, the intake-side camshaft 16 and the exhaust-side camshaft 17 are rotated with the rotation of the crank shaft 12, and cams which are attached to the camshafts 16, 17 and not shown in the figure, are also rotated. By the rotation of the cams, protruding portions of the cams (cam ridges) push down the intake valve and the exhaust valve (not shown) against biasing force of valve springs, to bring the intake valve and the exhaust valve into an open state from a closed state.

The intake valve is provided with a hydraulic valve timing adjustment device 18. By this valve timing adjustment device 18, a rotation phase of the intake-side camshaft 16 (camshaft phase) with respect to the crank shaft 12 is changed, and opening and closing timing for the intake valve (valve timing) is changed.

The valve timing adjustment device 18 is connected with a hydraulic pump 21 via a hydraulic passage 19. The hydraulic pump 21 takes the engine 11 as a drive source, and is driven by transmission of energy from the crank shaft 12 via the timing chain. Further, the crank shaft 12 is rotated and the hydraulic pump 21 is driven, thereby allowing supply of oil in an oil pan 22 as hydraulic oil to the valve timing adjustment device 18. It is to be noted that an electronic pump may be used as the hydraulic pump 21.

In the hydraulic passage 19, an oil control valve (OCV) 20 is disposed in an intermediate position between the hydraulic pump 21 and the valve timing adjustment device 18. The OCV 20 is a spool valve, and is provided with: a cylindrical sleeve 24; a spool 25 which is housed in the sleeve 24 in a coaxial manner to the sleeve 24 and is slidable in a shaft direction; and a plurality of ports 26 (26*a* to 26*f*) provided in the sleeve 24. It is to be noted that the OCV 20 of the present embodiment is provided inside the valve timing adjustment device 18 (e.g., inside the vane housing chamber 30), and is integrated with the valve timing adjustment device 18.

In the OCV 20, the spool 25 reciprocates in the shaft direction to change its position (spool position), thereby switching the oil passage connecting between the ports. Thus, an amount of the oil supplied to and an amount of the oil discharged from the valve timing adjustment device 18 are adjusted. Such adjustment of the amounts of the oil supplied and discharged changes the camshaft phase, thereby changing the valve timing for the intake valve.

Other than the above, in the system, a cam angle sensor 61 for outputting a cam angle signal for each predetermined cam angle is provided in a position facing the intake-side camshaft 16. Further, a crank angle sensor 62 for outputting a crank angle signal for each predetermined crank angle is provided in a position facing the crank shaft 12. Moreover, in the system, there are provided a variety of sensors such as an oil temperature sensor 63 for detecting a temperature of oil, and a cooling water temperature sensor 64 for detecting a temperature of cooling water of the engine 11.

An ECU 60 is an electric control device provided with a known microcomputer and the like, and performs a variety of engine controls such as fuel jet amount control, ignition control, idling stop control, and valve timing control, based on a detection result and the like of the variety of sensors provided in the system.

Schematically, the idling stop control is to automatically stop the engine 11 when a predetermined automatic stop condition is met during idle operation of the engine 11, and then restart the engine 11 when a predetermined restart condition is met. The automatic stop condition includes at least, for example, any of that accelerator operation amount has been zero, that brake pedal stepping operation has been performed, that a vehicle speed has decreased to a predetermined value or lower. Further, the automatic restart condition includes at least any of that accelerator operation has been performed in an automatically stopped state of the engine 11, that the stepping of the brake pedal has been released, and the like.

For the valve timing control, the ECU 60 calculates a rotation phase (actual camshaft phase) of the camshaft 16 with respect to the crank shaft 12, and also calculates a target camshaft phase in accordance with an engine operation state, based on output signals of the cam angle sensor 61 and the crank angle sensor 62. Further, in order to make the actual camshaft phase agree with the target camshaft phase, oil pressure of the valve timing adjustment device 18 and oil pressure of the lock pin 42 are adjusted by feedback control (F/B control) of a control duty of the OCV 20. In the present embodiment, a value of a current flowing through the OCV 20 is detected and an actual spool position is estimated based on the detected current value, and the spool position is controlled by current feedback control on the basis of a deviation between the estimated actual spool position and the target value. As for the device for detecting the actual spool position, in place of the configuration to make the estimation by calculation, a position detection sensor for detecting a spool position may be installed, and direct detection may be performed by this sensor.

The valve timing adjustment device 18 will be described in detail with reference to FIGS. 2, 3, 4A and 4B. The valve timing adjustment device 18 is provided with a housing 31 with a plurality of vane housing chambers 30 formed therein, and this housing 31 is fixed to the sprocket 14 of the intake-side camshaft 16. In the vane housing chamber 30, a vane 34 formed on an outer periphery of a rotor 33 is disposed, and the vane housing chamber 30 is sectioned into an advancement chamber 35 and a retardation chamber 36 by the vane 34. A stopper section 37 for regulating a relative rotation range of the rotor 33 (vane 34) with respect to the housing 31 is formed on each side section of at least one of a plurality of vanes 34. This stopper section 37 regulates the most advanced phase and the most retarded phase which are limit values of an adjustable range of the camshaft phase.

The valve timing adjustment device 18 is provided with an intermediate lock mechanism 40 for fixing the camshaft phase to the intermediate lock phase provided between the most advanced phase and the most retarded phase. The intermediate lock mechanism 40 includes a lock pin housing hole 41 provided in one or a plurality of vanes 34, and a lock pin 42 housed in this lock pin housing hole 41. The lock pin 42 is attached projectably from the lock pin housing hole 41 by biasing force of a spring 44. In a state where the lock pin 42 projects toward the sprocket 14 and is fitted in a lock hole 43 of the sprocket 14, the camshaft phase is locked in the intermediate lock phase, and relative rotation of the housing 31 and the rotor 33 (vane 34) is locked. The intermediate lock phase is set in a phase suitable for starting of the engine 11. The lock hole 43 may be provided in the housing 31.

Figure 4A:
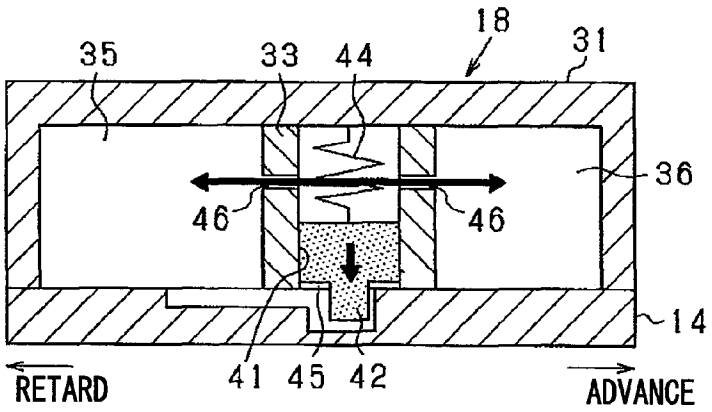
FIG. 4A is a configuration diagram showing an outline of an intermediate lock mechanism.
Figure 4B:
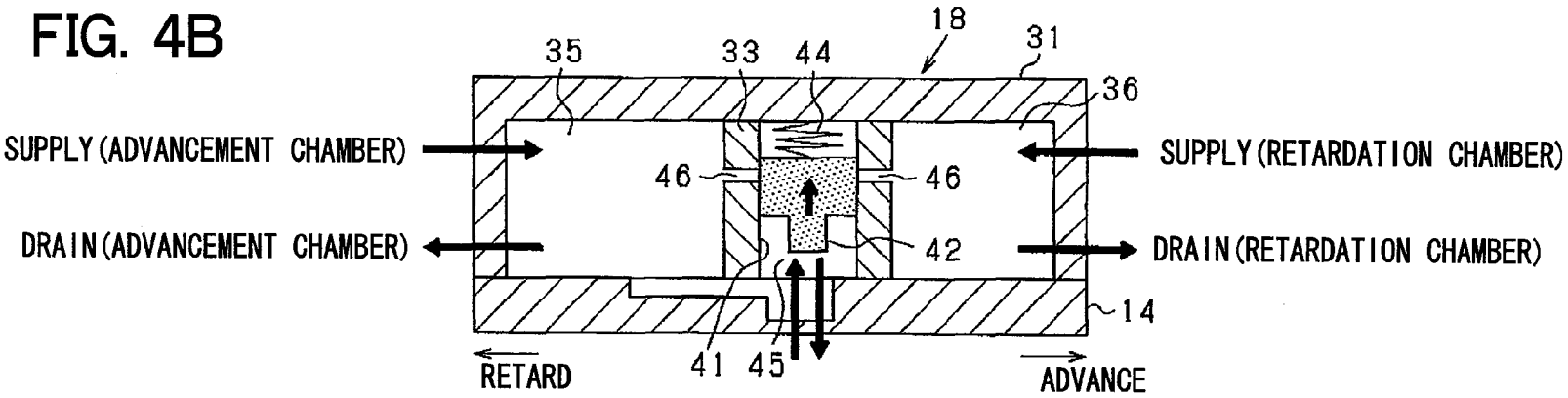
FIG. 4B is a configuration diagram showing an outline of the intermediate lock mechanism.

Inside the lock pin housing hole 41, a lock release chamber 45 is formed between the lock pin 42 and the lock hole 43, as an oil pressure chamber for lock release, into and out of which the oil flows. In a state where the lock release chamber 45 is not filled with the oil, as shown in FIG. 4A, the lock pin 42 projects toward the locking direction by biasing force of the spring 44 and is fitted into the lock hole 43. The relative rotation of the vane 34 with respect to the housing 31 is thereby locked, to fix the camshaft phase to the intermediate lock phase. On the other hand, when the lock release chamber 45 is filled with the oil and oil pressure in the lock release chamber 45 becomes high, as shown in FIG. 4B, the lock pin 42 moves in the lock releasing direction against the biasing force of the spring 44. Accordingly, the lock of the relative rotation of the vane 34 with respect to the housing 31 is released, and rotation of the vane 34 in an advancing direction or a retarding direction is permitted.

As shown in FIGS. 4A and 4B, a communication passage 46 for communicating the advancement chamber 35 and the retardation chamber 36 is formed in the rotor 33. In a state where the lock pin 42 has been pulled out of the lock hole 43 (lock released state), as shown in FIG. 4B, the communication passage 46 is closed by the lock pin 42, and hence transfer of the oil between the advancement chamber 35 and the retardation chamber 36 are blocked. On the other hand, in the state where the lock pin 42 projects and is fitted in the lock hole 43 (locked state), as shown in FIG. 4A, the communication passage 46 enters an open state, and the oil can pass between the advancement chamber 35 and the retardation chamber 36.

The OCV 20 is an oil pressure adjustment valve formed by integrating a hydraulic control function for changing the camshaft phase with an oil pressure control function for driving the lock pin, and adjusts inflow and outflow of the oil to and from the advancement chamber 35, the retardation chamber 36, and the lock release chamber 45 by means of the spool position.

Figure 2:
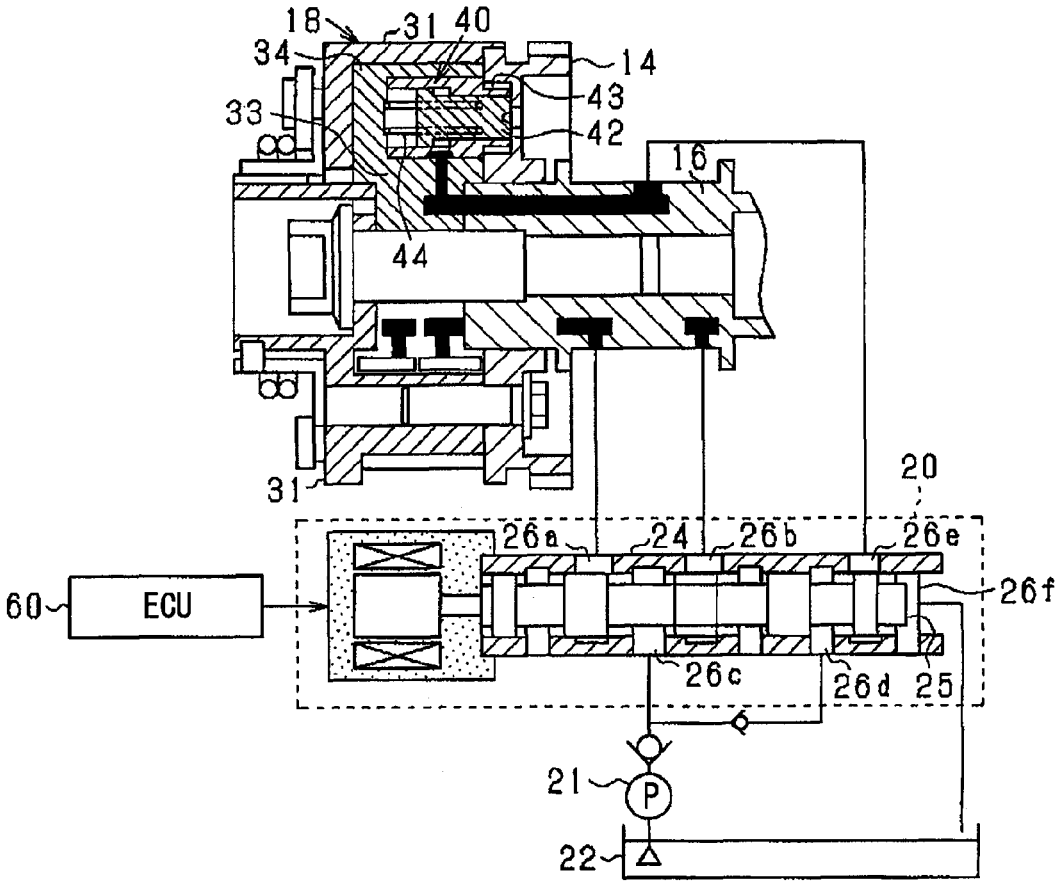
FIG. 2 is a schematic configuration diagram of a valve timing adjustment device.
Figure 3:
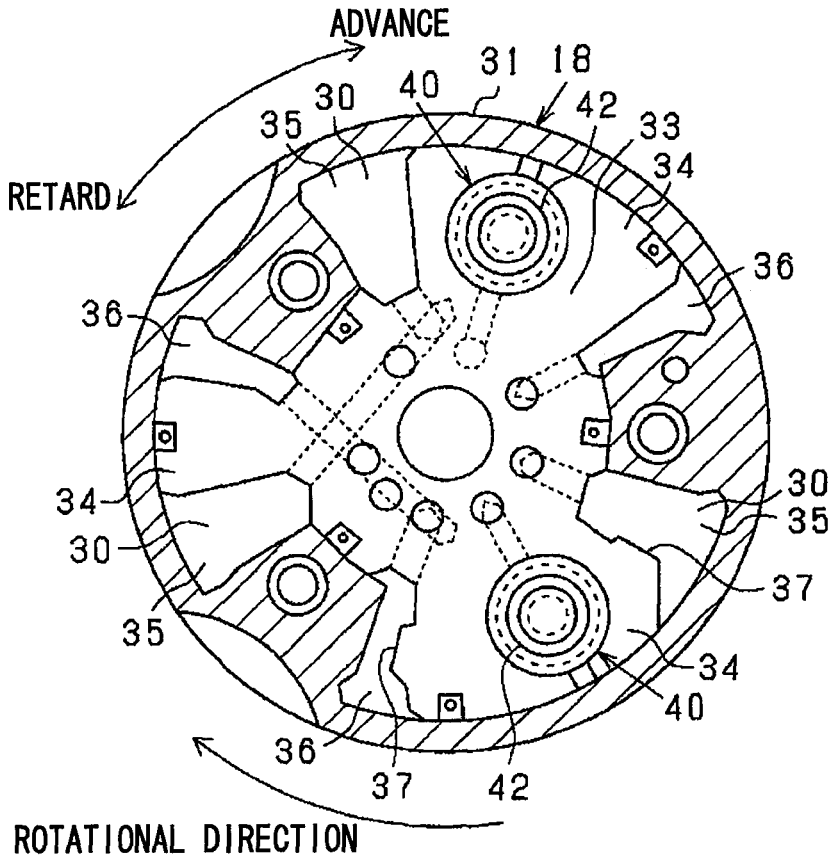
FIG. 3 is a vertical sectional diagram of the valve timing adjustment device.

Specifically, as shown in FIG. 2, the OCV 20 includes, as a plurality of ports 26, an advancement port 26*a*, a retardation port 26*b*, a main supply port 26*c*, a sub supply port 26*d*, a lock release port 26*e*, and a drain port 26*f*. The OCV 20 switches the coupled state between these ports by changing the position of the spool 25, and in accordance with the coupled state, the OCV 20 adjusts supply of the oil to the advancement chamber 35, the retardation chamber 36, and the lock release chamber 45, and discharge of the oil from each of those oil pressure chambers.

Figure 5:
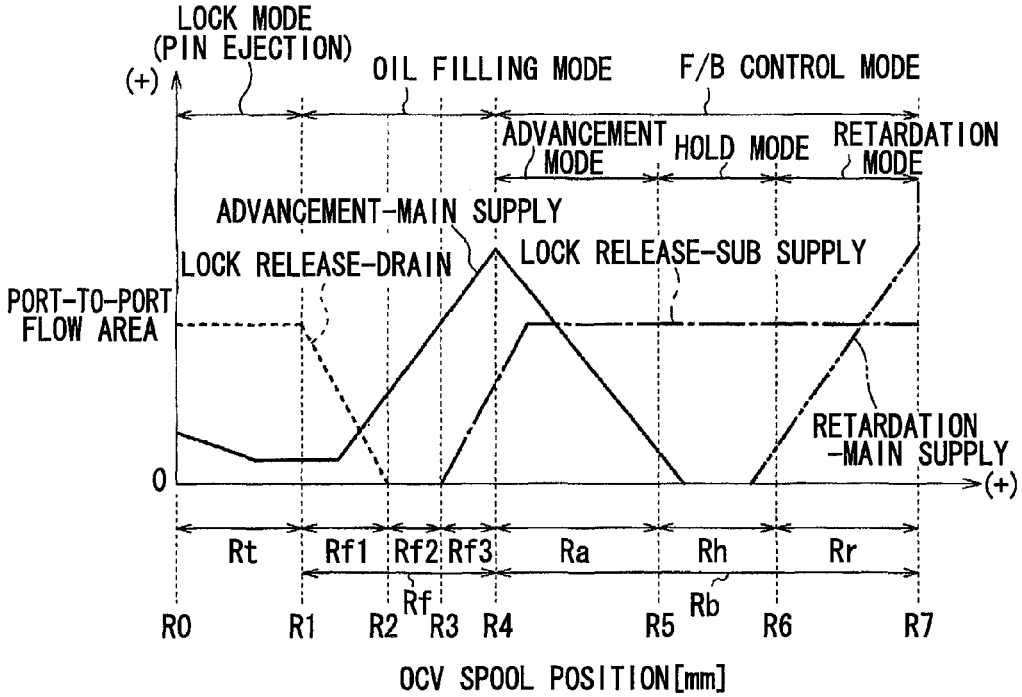
FIG. 5 is a characteristic diagram showing a relation between a spool position in an OCV and a port-to-port flow passage area.

FIG. 5 shows a relation between the spool position in the OCV 20 and a port-to-port flow passage area. In FIG. 5, a solid line indicates an oil passage that couples between the advancement port 26*a* and the main supply port 26*c*, a broken line indicates an oil passage that couples between the lock release port 26*e* and the drain port 26*f*, a dashed line indicates an oil passage that couples between the lock release port 26*e* and the sub supply port 26*d*, and a two-dot line indicates an oil passage that couples between the retardation port 26*b* and the main supply port 26*c*. Those lines indicate port-to-port flow areas of the oil passages with respect to the spool position. It is to be noted that in FIG. 5, descriptions of port-to-port flow areas of an oil passage that couples between the retardation port and the drain port and an oil passage that couples between the advancement port and the drain port are omitted.

As shown in FIG. 5, in the OCV 20, a movement region of the spool 25 is divided into three control regions for a lock mode, an oil filling mode, and an F/B control mode in accordance with the spool position. Those regions are respectively a lock region Rt, an oil filling region Rf, and an F/B control region Rb. The lock region Rt, the oil filling region Rf, and the F/B control region Rb are aligned in this order in the shaft direction of the spool 25. Further, the F/B control mode is further divided into three control regions for an advancement mode, a hold mode, and a retardation mode (advancement region Ra, hold region Rh, and a retardation region Rr).

The control region in the lock mode is a region from a reference position R0 (in the present embodiment, control duty=0) to a position R1, which is set within the movement region of the spool 25. In a state where the spool 25 has moved to this lock region Rt, the lock release port 26*e* and the drain port 26*f* are coupled with each other, thereby discharging the oil from the lock release chamber 45. Accordingly, the lock pin 42 is fitted into the lock hole 43, and the camshaft phase is held in the intermediate lock phase.

The control region in the oil filling mode is a region sandwiched between the lock region Rt and the F/B control region Rb, and in the present embodiment, it is from the position R1 to a position R4. In a state where the spool 25 has moved to this oil filling region Rf, the flow area of the oil passage that couples between the lock release port 26*e* and the drain port 26*f* is reduced (broken line of FIG. 5), and the flow passage area of the oil passage that couples between the advancement port 26*a* and the main supply port 26*c* is expanded, to supply the advancement chamber 35 with the oil (solid line of FIG. 5). Further, in the oil filling region Rf, the oil is not supplied to the lock release chamber 45, or even when the oil is supplied to the lock release chamber 45, pressure in the lock release chamber 45 is low (dashed line of FIG. 5), and the state where the lock pin 42 is fitted in the lock hole 43 is held. Therefore, the communication passage 46 is in an open state, and the oil supplied to the advancement chamber 35 is also introduced into the retardation chamber 36 through the communication passage 46. It is to be noted that in the lock region Rt and the oil filling region Rf, the oil passage that couples between the retardation port and the drain port is in a blocked state, though not shown. Hence in the oil filling mode, the advancement chamber 35 and the retardation chamber 36 are filled with the oil with the locked state remained.

More specifically, in the oil filling region Rf, the closer the position to the F/B control mode side from the lock mode side, the larger the flow passage area of the oil passage that couples between the advancement port 26*a* and the main supply port 26*c*. Further, the lock mode-side region (lock-side region Rf1) out of the oil filling region Rf is in a state where complete closure of the oil passage that couples between the lock release port 26*e* and the drain port 26*f* is not performed, namely in a state where the outflow passage for the oil from the lock release chamber 45 is still open, and the port-to-port flow area gradually decreases as the spool position is getting closer to the F/B control mode side. On the other hand, the F/B control mode-side regions (F/B-side regions Rf2, Rf3) out of the oil filling region Rf are in a state where the oil passage that couples between the lock release port 26*e* and the drain port 26*f* is closed. Further, the region Rf2 adjacent to the lock-side region Rf1 out of the oil F/B-side regions Rf2, Rf3 is a region in which the lock release port 26*e* and the sub supply port 26*d* have not been coupled with each other, and the region Rf3 adjacent to the F/B control region Rb is a region in which the lock release port 26*e* and the sub supply port 26*d* have been coupled with each other. It is to be noted that in the region Rf3, the locked state is held when the oil pressure in the lock release chamber 45 is still low.

The control region in the advancement mode is a region from the position R4 to a position R5. In a state where the spool 25 has moved to this advancement region Ra, the advancement port 26*a* and the main supply port 26*c* of the OCV 20 enter in a coupled state, and the retardation port 26*b* and the drain port 26*f* enter in a coupled state. At this time, by feedback control in accordance with a deviation between the actual camshaft phase and the target camshaft phase, the oil supply passage to the advancement chamber 35 is opened with its flow passage area in accordance with the deviation, and the oil is supplied to the advancement chamber 35. The oil pressure in the advancement chamber 35 is thereby changed, to advancement the actual camshaft phase. The control region in the hold mode is a region from the position R5 to a position R6. In a state where the spool has moved to this hold region Rh, the oil passages for supplying and discharging the oil to and from both the advancement chamber 35 and the retardation chamber 36 are blocked, or amounts of the oil supplied to both the chambers 35, 36 are made equivalent, to hold the oil pressure in both the chambers 35, 36. The actual camshaft phase is thereby held so as not to move.

The control region in the retardation mode is a region from the position R6 to a position R7. In a state where the spool 25 has moved to this retardation region Rr, the retardation port 26*b* and the main supply port 26*c* of the OCV 20 enter in a coupled state, and the advancement port 26*a* and the drain port 26*f* enter in a coupled state. At this time, by feedback control in accordance with a deviation between the actual camshaft phase and the target camshaft phase, the oil supply passage to the retardation chamber 36 is opened with its flow passage area in accordance with the deviation, and the oil is supplied to the retardation chamber 36. The oil pressure in the retardation chamber 36 is thereby changed, to change the actual camshaft phase to the retardation side.

In the control region in the F/B control mode (advancement mode, hold mode, retardation mode), the lock release port 26*e* and the sub supply port 26*d* are coupled with each other (dashed line of FIG. 5), and the oil is supplied to the lock release chamber 45. The oil pressure in the lock release chamber 45 is thereby increased, to pull the lock pin 42 out of the lock hole 43 and bring it into a lock released state. It is to be noted that in the present embodiment, at the position R4, the lock pin 42 moves in the lock releasing direction against biasing force of the spring 44, and the lock is released.

In the present embodiment, it is configured that with increase in control duty value of the OCV 20, a value of the spool position from the reference position R0 increases (R0<R1<R2<R3<R4<R5<R6<R7). That is, with increase in control duty value of the OCV 20, the control mode is switched in order of the lock mode, the oil filling mode, the advancement mode, the hold mode, and the retardation mode. It is to be noted that the lock region Rt corresponds to the first region, the oil filling region Rf (Rf1, Rf2, Rf3) corresponds to the second region, and the F/B control region Rb corresponds to the third region. Further, out of the oil filling region Rf, the region Rf1 corresponds to the outflow permitted region, and the regions Rf2, Rf3 correspond to the outflow prohibited region. The F/B control mode corresponds to the phase control mode.

The ECU 60 selects one of the lock mode, the oil filling mode, and the F/B control mode in accordance with the engine operation state, and adjusts inflow and outflow of the oil to and from the advancement chamber 35, the retardation chamber 36, and the lock release chamber 45 by the OCV 20 in the selected mode. Specifically, at stopping of the engine, the lock mode is selected, and the target position of the spool 25 (spool control target position) is set within the lock region Rt, thereby fixing the camshaft phase to the intermediate lock phase. Then, when an engine start request is generated, the engine is started in the intermediate lock phase, and the F/B control mode is selected after the starting of the engine 11 has been completed. While the lock is released by this F/B control mode, the OCV 20 is controlled such that the actual camshaft phase is the target camshaft phase in accordance with the engine operation state. Further, the oil filling mode is selected before a shift is made to the F/B control mode, and the lock is released by the F/B control mode after the advancement chamber 35 and the retardation chamber 36 are filled with the oil. Accordingly, a response delay and a flap of the vane 34 after the lock release are reduced, to enhance the followability with respect to the target value of the camshaft phase.

For quickly making a shift to the F/B control mode after starting of the engine, it is desirable to quickly perform oil filling of the advancement chamber 35 and the retardation chamber 36. From such a viewpoint, at the time of oil filling in the oil filling mode, it is considered that the spool control target position is set to be as close to the F/B control mode side as possible in the oil filling region Rf. This is because the closer the target position to the F/B control mode side, the larger the flow passage sectional area of the oil supply passage to the advancement chamber 35, and the larger the amount of the oil supplied to the advancement chamber 35.

However, as shown in FIG. 5, on the F/B control mode side within the oil filling region Rf, the lock release port 26*e* and the drain port 26*f* are not coupled with each other, and an outflow channel for the oil from the lock release chamber 45 is in a closed state. Further, under circumstances where viscosity of the oil is low, such as at the time when the oil is at a high temperature, it is considered that the oil flows into the oil supply passage which is communicated with the lock release chamber 45 due to oil leakage inside the OCV 20, or the like. At this time, when the outflow channel for the oil from the lock release chamber 45 is in the closed state, it is concerned that the oil having unintentionally flown into the lock release chamber 45 stays in the lock release chamber 45 as it is, and the oil pressure in the lock release chamber 45 reaches lock release pressure, resulting in erroneous release of the lock pin 42.

On the other hand, on the lock mode side within the oil filling region Rf, the state where the lock release port 26*e* and the drain port 26*f* are coupled with each other remains although the flow passage area is not the maximum. For this reason, even when the oil unintentionally flows into the lock release chamber 45, the oil is discharged from the lock release chamber 45, and there is thus a little concern about the erroneous release of the lock pin 42. However, an opening area of the oil supply passage which is communicated to the advancement chamber 35 is small, and the amount of the oil supplied to the advancement chamber 35 is small. Hence it is concerned that the oil filling of the advancement chamber 35 and the retardation chamber 36 takes time.

Accordingly, in the present embodiment, when the oil filling mode has been selected as the control mode for adjusting inflow and outflow of the oil by the OCV 20, the target position of the spool 25 (spool control target position) is calculated based on the oil viscosity. Then, conduction control is performed such that the spool position of the OCV 20 is the target position.

More specifically, when the oil has a low temperature and a high viscosity, the spool control target position is set closer to the F/B control mode side than when the oil has a high temperature and a low viscosity. Accordingly, when the oil filling requires time and there is a low possibility that the lock pin 42 is erroneously released due to oil leakage inside the OCV 20 or the like as in the case of the oil having a low temperature, the spool 25 is disposed in a position with a large flow passage area of the oil supply passage to the advancement chamber 35, so as to prioritize the oil filling. On the other hand, when the oil filling does not require much time and there is a high possibility that the lock pin 42 is erroneously released due to oil leakage inside the OCV 20 or the like as in the case of the oil having a high temperature, the spool 25 is disposed in a position with a small flow passage area of the oil supply passage to the advancement chamber 35, so as to prioritize avoidance of the erroneous release of the lock pin 42.

Figure 6:
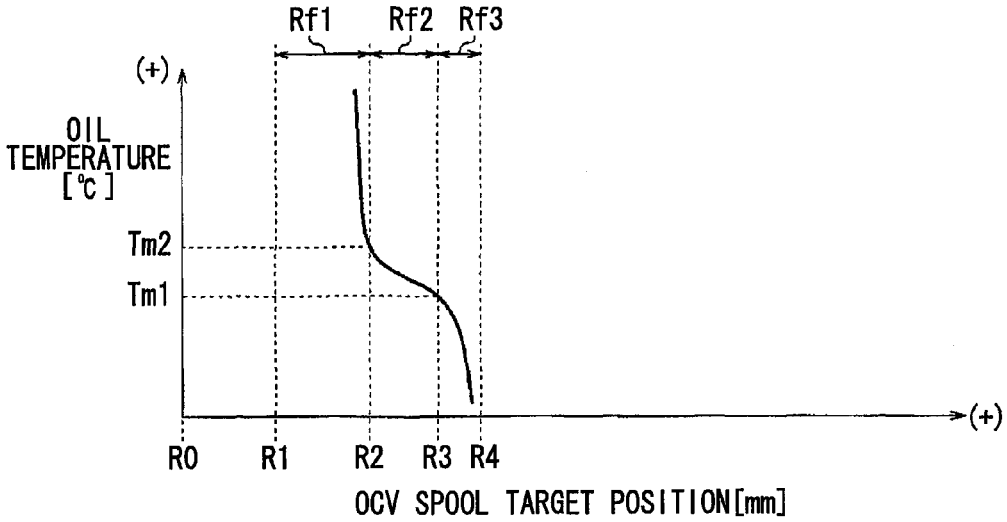
FIG. 6 is a spool control target position setting map of a first embodiment.

FIG. 6 is a target position setting map in the oil filling mode of the present embodiment. According to this map, the spool control target position is set in accordance with the oil temperature. Specifically, when the oil temperature is on the lower temperature side than a first temperature Tm1, the spool control target position is set in the region Rf3 (between the position R3 and the position R4) not reaching the position R4 at which the lock pin 42 is pulled out of the lock hole 43. Further, when the oil temperature is in an intermediate temperature region not lower than the first temperature Tm1 and not higher than a second temperature Tm2, the spool control target position is set in the region Rf2 between the position R2 and the position R3. When the oil temperature is on the higher temperature side than the second temperature Tm2, the spool control target position is set in the region Rf1 adjacent to the lock region Rt.

Figure 7:
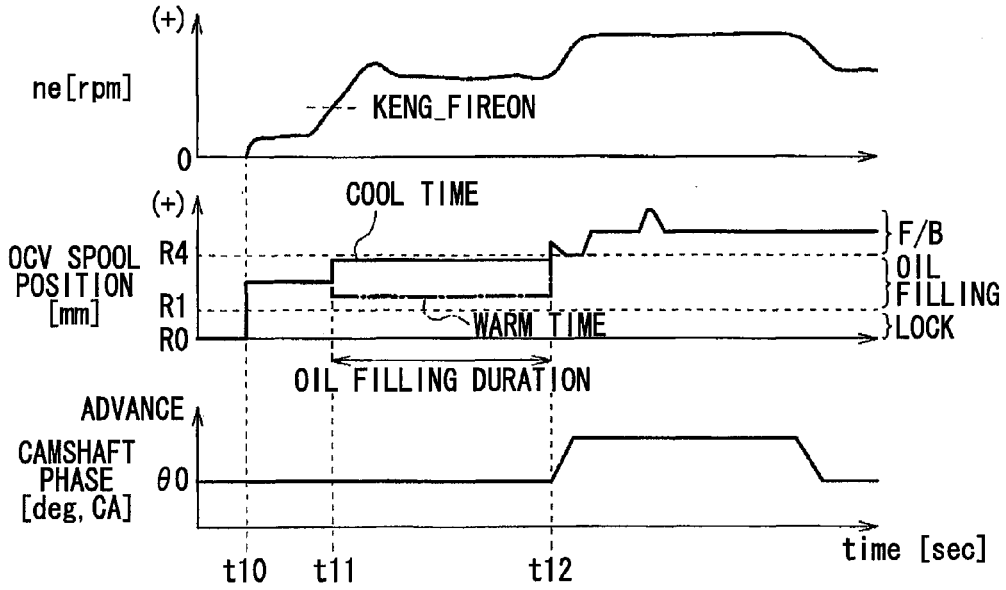
FIG. 7 is a time chart showing a specific aspect in a lock filling mode of the first embodiment.

FIG. 7 is a time chart showing a specific aspect in the lock filling mode of the present embodiment. The figure shows a shift of an engine speed, a shift of the spool position of the OCV 20, and a shift of the camshaft phase of the intake valve. It is to be noted that in FIG. 7, the engine start time is assumed.

In FIG. 7, it is assumed that a request for starting the engine 11 is generated during stopping of the engine. During stopping of the engine, the lock pin 42 is in the state of being fitted in the lock hole 43, and the camshaft phase is fixed to the intermediate lock phase θ0. At a time t10 when the engine start request is generated, clanking of the engine 11 is started by a starter, not shown. Further, the spool control target position is changed from the lock region Rt to the oil filling region Rf.

In the present embodiment, until an engine speed ne increases with starting of the engine and pressure of the oil (oil pressure) sufficiently increases (before a time t11), the spool control target position is set in a previously set intermediate position KOCV2_BASE. In the present embodiment, the intermediate position KOCV2_BASE is set in the central position of the oil filling region Rf. Then, when the oil pressure is sufficiently high, the spool control target position is set in accordance with an oil temperature detected by the oil temperature sensor 63 by use of the target position setting map of FIG. 6. For example, when the oil temperature is lower than the first temperature Tm1, the spool control target position is set in the vicinity of the position R4 in a range not exceeding R4 (solid line). Further, when the oil temperature is higher than the second temperature Tm2, the spool control target position is set within the lock-side region Rf1. When the oil filling of the advancement chamber 35 and the retardation chamber 36 is completed, the spool position of the OCV 20 is controlled by the F/B control mode after a time t12.

Figure 8A:
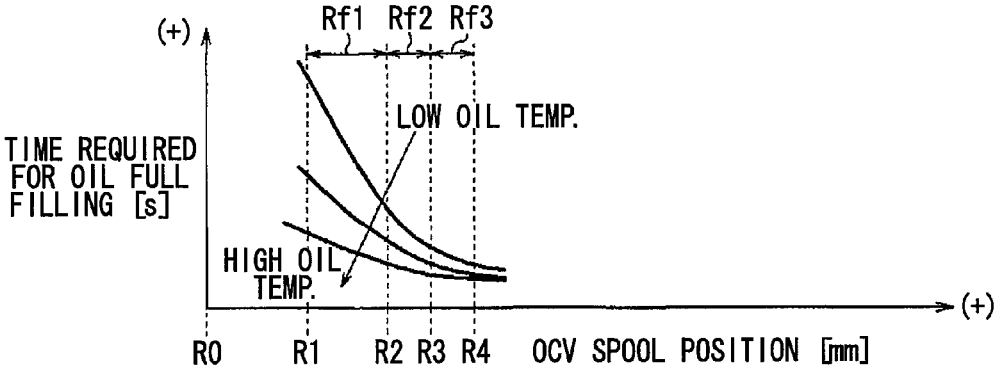
FIG. 8A is a characteristic diagram showing a relation among oil full filling time, pin erroneous release time, and an oil temperature.
Figure 8B:
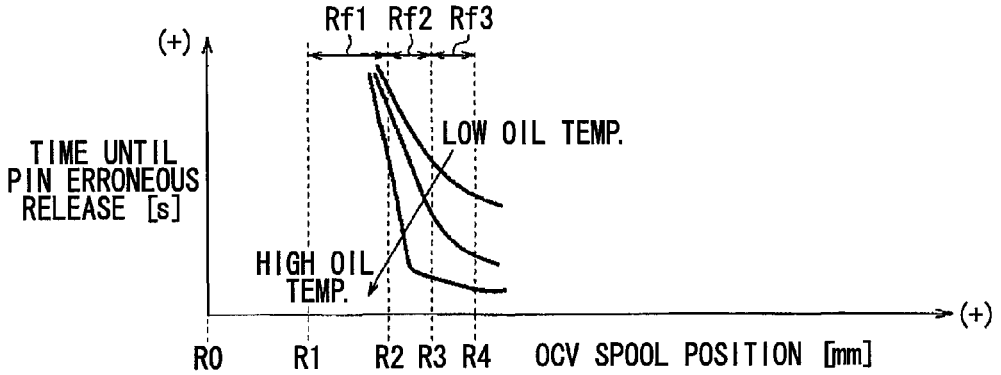
FIG. 8B is a characteristic diagram showing a relation among oil full filling time, pin erroneous release time, and an oil temperature.

Herein, lock erroneous release due to oil leakage inside the OCV 20 or the like normally occurs after the vane housing chamber 30 is fully filled with the oil. Further, the time taken until the vane housing chamber 30 is fully filled with the oil varies in accordance with the oil viscosity (oil temperature). Specifically, as shown in FIG. 8A, the higher the oil viscosity (the lower the oil temperature), the longer the time required until full filling with the oil. Therefore, the time required until occurrence of the pin erroneous release varies in accordance with the oil viscosity (oil temperature), and as shown in FIG. 8B, the higher the oil viscosity (the lower the oil temperature), the longer the time required until the pin erroneous release.

Figure 9:
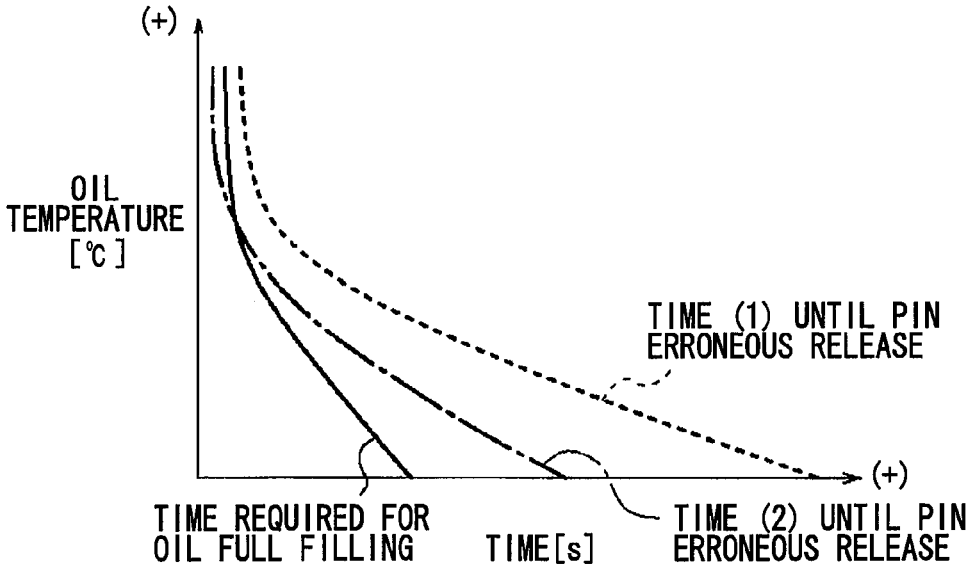
FIG. 9 is a temperature characteristic diagram of pin erroneous release.

FIG. 9 is a temperature characteristic diagram of the pin erroneous release. In FIG. 9, a solid line indicates time required from an empty state to full filling of the vane housing chamber 30 with the oil. A broken line indicates time (1) required until the pin erroneous release in the case of performing the oil filling from the empty state of the vane housing chamber 30. A dashed line indicates time (2) required until the pin erroneous release in the case of performing the oil filling from the full state of the vane housing chamber 30. It is to be noted that the broken line and the dashed line indicate the case where the spool position is set in the F/B side region Rf2 out of the oil filling region Rf. As seen from FIG. 9, the oil full filling time and the pin erroneous release time depend on the oil temperature. The higher the oil temperature, the shorter the oil full filling time and the pin erroneous release time is and the more the pin erroneous release is apt to occur.

Further, the time taken until full filling of the inside of the vane housing chamber 30 with the oil varies in accordance with a requested value of the amount of the oil supplied to the vane housing chamber 30 (requested oil filling amount qoil). Further, the requested oil filling amount qoil varies in accordance with how much oil remains in the vane housing chamber 30. Specifically, the larger the amount of the residual oil inside the vane housing chamber 30, the smaller the requested oil filling amount qoil, and the shorter the time required until full filling with the oil. Moreover, the amount of the residual oil inside the vane housing chamber 30 and the requested oil filling amount qoil vary in accordance with the time when the engine stop state continues (engine stop duration engoff_time).

Figure 10:
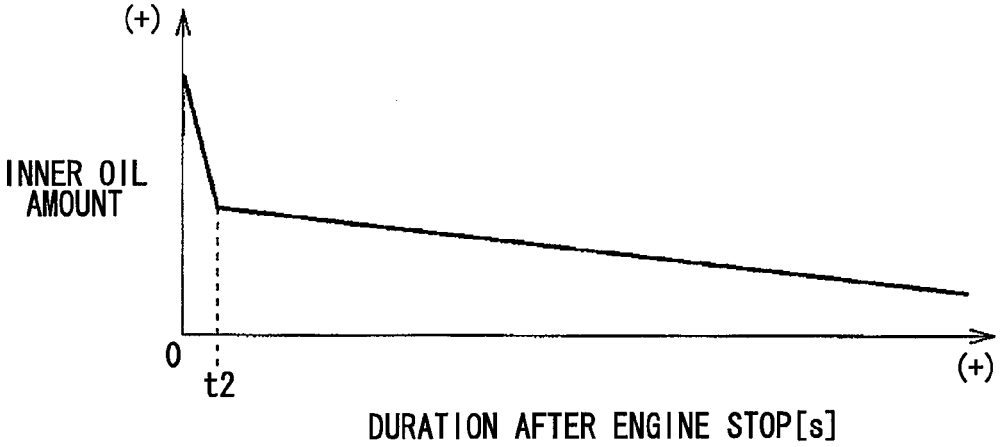
FIG. 10 is a characteristic diagram showing a relation between an engine stop duration and an amount of residual oil inside a vane storage chamber.

FIG. 10 is a characteristic diagram showing a relation between the engine stop duration engoff_time and the amount of the residual oil inside the vane housing chamber 30. It is to be noted that FIG. 10 shows a configuration where the OCV 20 is integrated with the valve timing adjustment device 18. As shown in FIG. 10, the oil inside the vane housing chamber 30 has a characteristic of quickly flowing out until its amount reaches a predetermined amount, and slowly flowing out of the vane housing chamber 30 from a time t2 after the predetermined amount of the oil has flown out. In the present embodiment, the requested oil filling amount qoil is calculated using this characteristic map, and the time corresponding to the calculated requested oil filling amount qoil is set for a requested value of duration of the oil filling mode (filling mode requested duration oiltime). Then, before a shift is made from the lock mode to the F/B control mode at starting of the engine, during the filling mode requested duration oiltime, the spool control target position is set within the region of R1 to R4.

Figure 11:
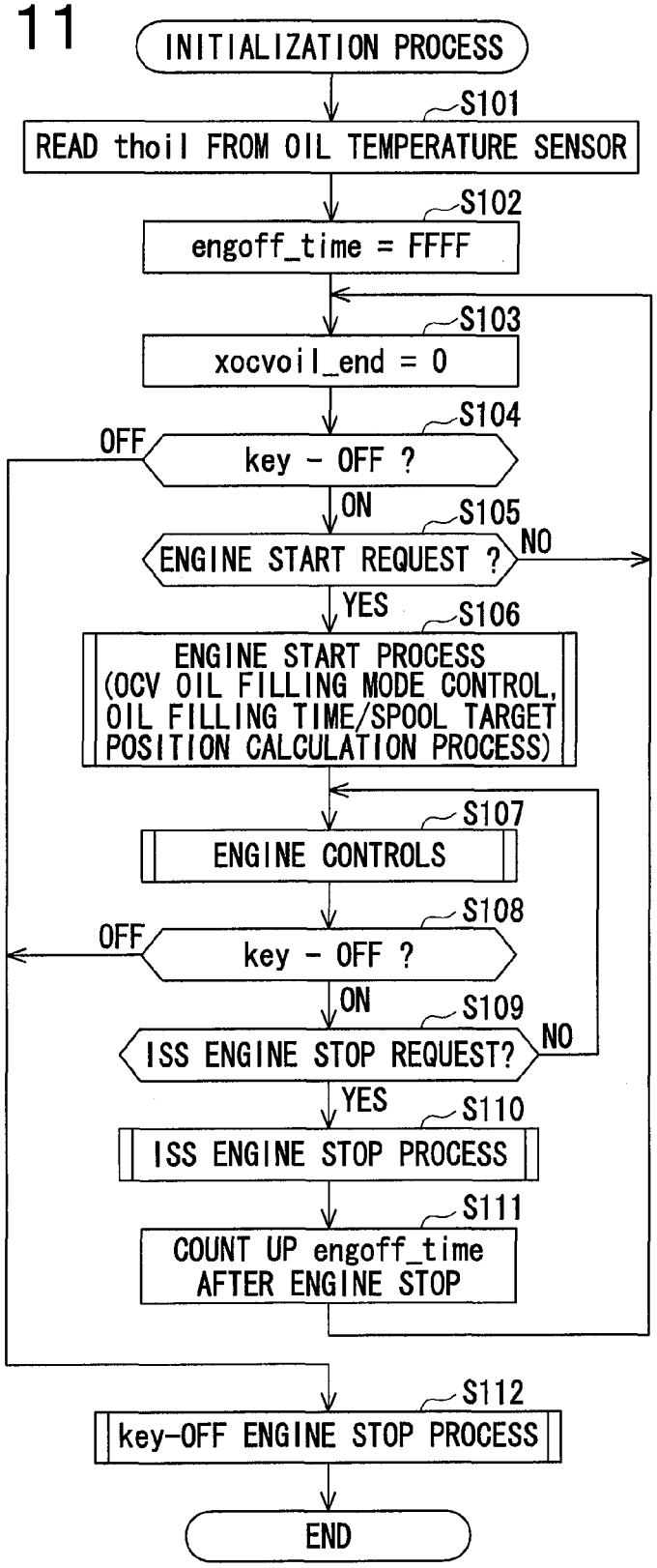
FIG. 11 is a main routine of engine control.
Figure 12:
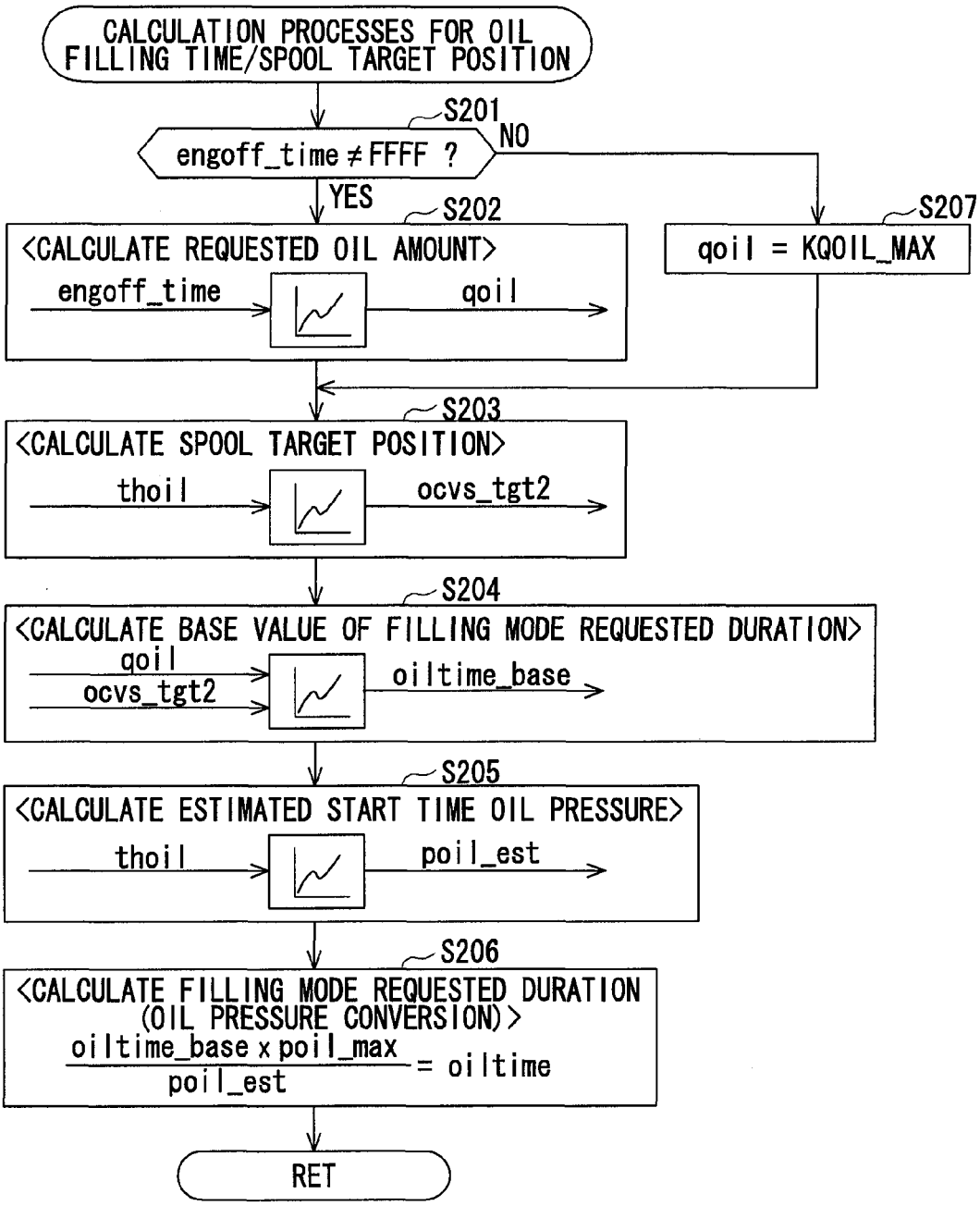
FIG. 12 is a flowchart showing a process procedure of calculation processes for oil filling time and a spool target position.
Figure 13:
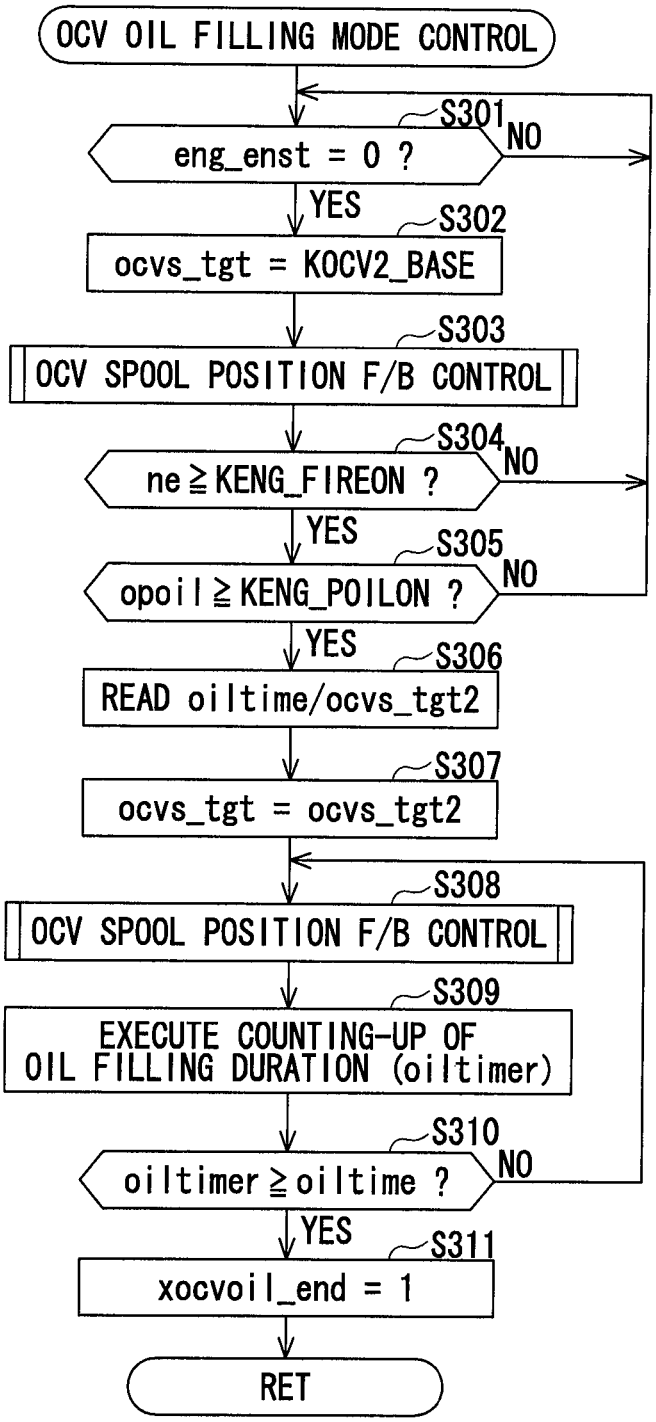
FIG. 13 is a flowchart showing a process procedure of OCV oil filling mode control.

Next, the OCV spool position control of the present embodiment will be described using flowcharts of FIGS. 11 to 13. FIG. 11 is a main routine of the engine control. FIG. 12 shows a process procedure of calculation processes for the oil filling time and the spool target position. FIG. 13 shows a process procedure of the OCV oil filling mode control.

First, the main routine of FIG. 11 will be described. Execution of this process is started by switching an engine key from off to on.

In FIG. 11, in Step S101, an oil temperature thoil is read from the oil temperature sensor 63. In Step S102, FFFF is set for the engine stop duration engoff_time. It is to be noted that FFFF is the engine stop duration engoff_time which is set when stopping of operation of the engine 11 continues with turning-off of the engine key. In subsequent Step S103, "0" is set for an oil filling completion flag xocvoil_end. This oil filling completion flag xocvoil_end is a flag showing whether or not oil filling of the vane housing chamber 30 by the oil filling mode has been completed, and the flag 1 indicates completion of the oil filling.

In Step S104, it is determined whether or not the engine key is not off. When the engine key is not off, the process proceeds to Step S105, and it is determined whether or not an engine start request has been generated. When the engine start request has been generated, the process proceeds to Step S106 in which "0" is set for an engine stop flag eng_enst, and an engine start process is executed. Although the engine start process is not shown, a variety of controls for starting the engine are executed in the process, the controls including drive control for a starter which is a start device for the engine 11, air amount control, fuel jet control, ignition control, the calculation process for the oil filling time and the spool target position of FIG. 12, and the OCV oil filling mode control of FIG. 13. When the engine start process is completed, the process proceeds to Step S107, and a variety of controls concerning operation of the engine 11 are executed. The variety of engine controls include fuel jet amount control, ignition control, idling stop control, valve timing control, and the like.

In Step S108, it is determined whether or not the engine key is not off. When a positive determination is made, the process proceeds to Step S109, and it is determined whether or not the engine automatic stop request has been generated. When the engine automatic stop request has not been generated, the processes of Steps S107 to S109 are executed. On the other hand, when the engine automatic stop request has been generated, the process proceeds to Step S110. The engine automatic stop process is executed by another routine, not shown, and 1 is set for the engine stop flag eng_enst.

Subsequently, the process proceeds to Step S111, and counting-up of the engine stop duration engoff_time is performed. In the present embodiment, at the timing when the engine speed ne decreases with stopping of combustion of the engine 11 and pressure of the oil (oil pressure opoil) supplied to the vane housing chamber 30 is the threshold or lower, counting-up of the engine stop duration engoff_time is started. Further, at the timing when the start process for the engine 11 is started with the next engine start request and the oil pressure opoil is an oil pressure increase completion threshold KENG_POLON or higher, the counting-up of the engine stop duration engoff_time is stopped. Then, a value at stopping of the counting is stored into the ECU 60 as the engine stop duration engoff_time.

When it is determined in Step S104 or S108 that the engine key is off, the process proceeds to Step S112. While an engine stop process (not shown) is executed, 1 is set for the engine stop flag eng_enst. Thereafter, the present routine is completed.

Next, the process procedure of the calculation processes for the oil filling time and the spool target position of FIG. 12 will be described. This process is executed by the ECU 60 after the positive determination is made in Step S105 of FIG. 11.

In FIG. 12, in Step S201, it is determined whether or not a value different from FFFF has been set for the engine stop duration engoff_time. When a negative determination is made in Step S201, the process proceeds to Step S207, and a maximum value KQOIL_MAX is set for the requested oil filling amount qoil. When elapsed time from the last stopping of the engine is unclear, the requested oil filling amount qoil might not be correctly calculated, and hence the maximum value KQOIL_MAX is set for the requested oil filling amount qoil in consideration of the safety. On the other hand, when a positive determination is made in Step S201, the process proceeds to Step S202, and the requested oil filling amount qoil is calculated based on the engine stop duration engoff_time. In the present embodiment, a map associating the engine stop duration engoff_time with the requested oil filling amount qoil (e.g., map shown in FIG. 10) is previously stored. The ECU 60 performs a process of inputting the engine stop duration engoff_time and also reading the requested oil filling amount qoil corresponding to the inputted engine stop duration engoff_time. It is to be noted that the map may be made to associate the previously stored requested oil filling amount qoil not only with the engine stop duration engoff_time but also with an oil temperature thoil.

In subsequent Step S203, a temperature dependent spool target position ocv_tgt2 is calculated based on the oil temperature thoil. Here is performed a process of inputting the oil temperature thoil detected by the oil temperature sensor 63 and reading the spool target position ocv_tgt2 corresponding to the oil temperature thoil by use of the target position setting map of FIG. 6.

In subsequent Step S204, the requested oil filling amount qoil and the temperature dependent spool target position ocv_tgt2 are inputted, and based on those inputted values, a base value oiltime_base of the filling mode requested duration is calculated. In the present embodiment, a base value setting map showing the relation among the requested oil filling amount qoil, the spool position ocv_tgt2 and the base value oiltime_base is previously stored. By use of this map, the base value oiltime_base corresponding to the requested oil filling amount qoil and the spool target position ocv_tgt2 is read. In this base value setting map, the larger the requested oil filling amount qoil, or the closer the spool target position ocv_tgt2 is to the lock mode side, the larger value the base value oiltime_base of the filling mode requested duration has been set to. It is to be noted that in this map, the base value oiltime_base at the time when oil pressure of the oil supplied to the vane housing chamber 30 is a maximum value poil_max is set.

In subsequent Step S205, the oil pressure (start time oil pressure poil_est) of the oil supplied to the vane housing chamber 30 is calculated. Herein, based on the oil temperature detected by the oil temperature sensor 63, the start time oil pressure poil_est is calculated using the previously stored map. In this map, the higher the oil temperature, the lower value the start time oil pressure poil_est has. It may be configured that, instead of using the map, an oil pressure sensor for detecting oil pressure is installed, to directly detect the oil pressure.

In subsequent Step S206, the base value oiltime_base of the filling mode requested duration is subjected to oil pressure conversion, to calculate the filling mode requested duration oiltime. Herein, the filling mode requested duration oiltime is calculated by the following formula (1). Subsequently, the present process is completed.

$$(\text{oiltime_base} \times \text{poil_max})/(\text{poil_est}) = \text{oiltime} \quad (1)$$

Next, the process procedure of the oil filling mode control of FIG. 13 will be described. This process is executed by the ECU 60 after the positive determination is made in Step S105 of FIG. 11.

In FIG. 13, in Step S301, it is determined whether or not the engine stop flag eng_enst is 0. When "eng_enst=0", the process proceeds to Step S302, and the spool control target position ocvs_tgt is set in the intermediate position KOCV2_BASE of the oil filling region Rf. In Step S303, the OCV 20 is subjected to the F/B control based on the spool control target position ocvs_tgt.

In subsequent Step S304, it is determined whether or not the engine speed ne is not lower than the complete explosion speed threshold KENG_FIREON, and when "ne KENG_FIREON", the process proceeds to Step S305. In Step S305, it is determined whether or not the oil pressure opoil has reached the oil pressure increase completion threshold KENG_POILON or higher. In the present embodiment, it is determined whether or not the oil pressure opoil has reached the oil pressure increase completion threshold KENG_POILON or higher based on the engine speed ne and the oil temperature thoil. It is to be noted that in the configuration where the oil pressure sensor is installed, a determination may be made using a detection value of the sensor. When "opoil≥KENG_POILON", the process proceeds to Step S306.

In Step S306, the filling mode requested duration oiltime and the OCV spool target position ocv_tgt2 are read. It is to be noted that these values oiltime, ocv_tgt2 are values calculated by the calculation processes for the oil filling time and the spool target position of FIG. 12. In subsequent Step S307, the spool control target position ocvs_tgt is changed to the spool target position ocv_tgt2 calculated based on the oil temperature, and in Step S308, the F/B control is executed based on the spool control target position ocvs_tgt.

In Step S309, counting-up of the oil filling duration oiltimer is performed. This oil filling duration oiltimer is a value showing elapsed time from determination that the oil pressure opoil has reached the oil pressure increase completion threshold KENG_POILON or higher. In subsequent Step S310, it is determined whether or not the oil filling duration oiltimer has become the filling mode requested duration oiltime or longer. When "oiltimer<oiltime", the F/B control based on the spool control target position ocvs_tgt is continued, and the oil filling is continued. When "oiltimer oiltime" is determined, the process proceeds to Step S311, and 1 is set for the oil filling completion flag xocvoil_end, and the routine is completed.

According to the present embodiment detailed above, the following excellent effect is obtained.

In the oil filling mode, it has been configured that the spool control target position ocvs_tgt is set in accordance with the oil viscosity and the spool position is controlled so as to be the set target position ocv_tgt. At starting of the engine, it is desirable to quickly fill the advancement chamber 35 and the retardation chamber 36 with the hydraulic oil and promptly make a shift to the F/B control mode, and in order to do so, it is desirable to dispose the spool 25 in a position where the amount of the oil supplied to the advancement chamber 35 and the retardation chamber 36 becomes as large as possible. On the other hand, when the oil viscosity is low, it is concerned that the oil may unintentionally flow into the lock release chamber 45 due to oil leakage inside the OCV 20, resulting in the erroneous release of the lock pin 42. In this respect, in the above configuration, the spool control target position ocvs_tgt in the oil filling mode is set in accordance with the oil viscosity, and hence it is possible to dispose the spool 25 in a position where the time required for oil filling of the advancement chamber 35 and the retardation chamber 36 can be reduced, while the erroneous release of the lock pin 42 can be avoided.

Second Embodiment

Next, a second embodiment will be described. In the first embodiment, it has been configured such that the spool position within the oil filling duration is held in the spool control target position in accordance with the oil temperature. In contrast, in the present embodiment, it is configured that the spool control target position within the oil filling duration is changed depending on the oil temperature and the requested oil filling amount qoil.

Specifically, the spool control target position is basically set within the F/B-side regions Rf2, Rf3, and the oil filling is performed in the set target position. However, when the filling mode requested duration oiltime in the case of assuming that the spool control target position is held in the F/B-side regions Rf2, Rf3 is longer than a pin erroneous release threshold oiltime_limt that is a previously set threshold as the time when the concern about the pin erroneous release occurs, setting the spool control target position in the F/B-side regions Rf2, Rf3 is completed before the oil filling duration oiltimer reaches the pin erroneous release threshold oiltime_limt. Especially in the present embodiment, it is configured that, when the filling mode requested duration oiltime is longer than the pin erroneous release threshold oiltime_limt, the spool control target position is changed to the lock-side region Rf1 before the oil filling duration oiltimer exceeds the threshold oiltime_limt. Hereinafter, a description will be given focusing on a different point from the above first embodiment.

Figure 14:
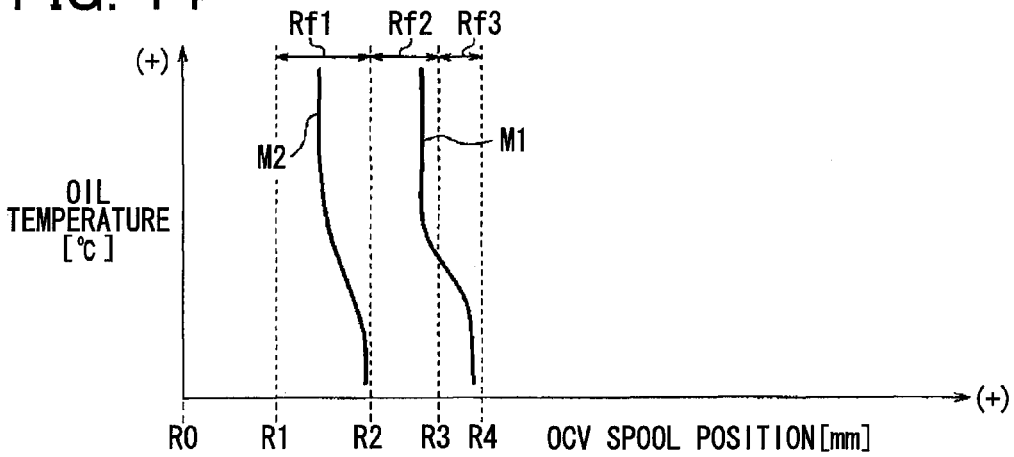
FIG. 14 is a spool control target position setting map of a second embodiment.
Figure 15:
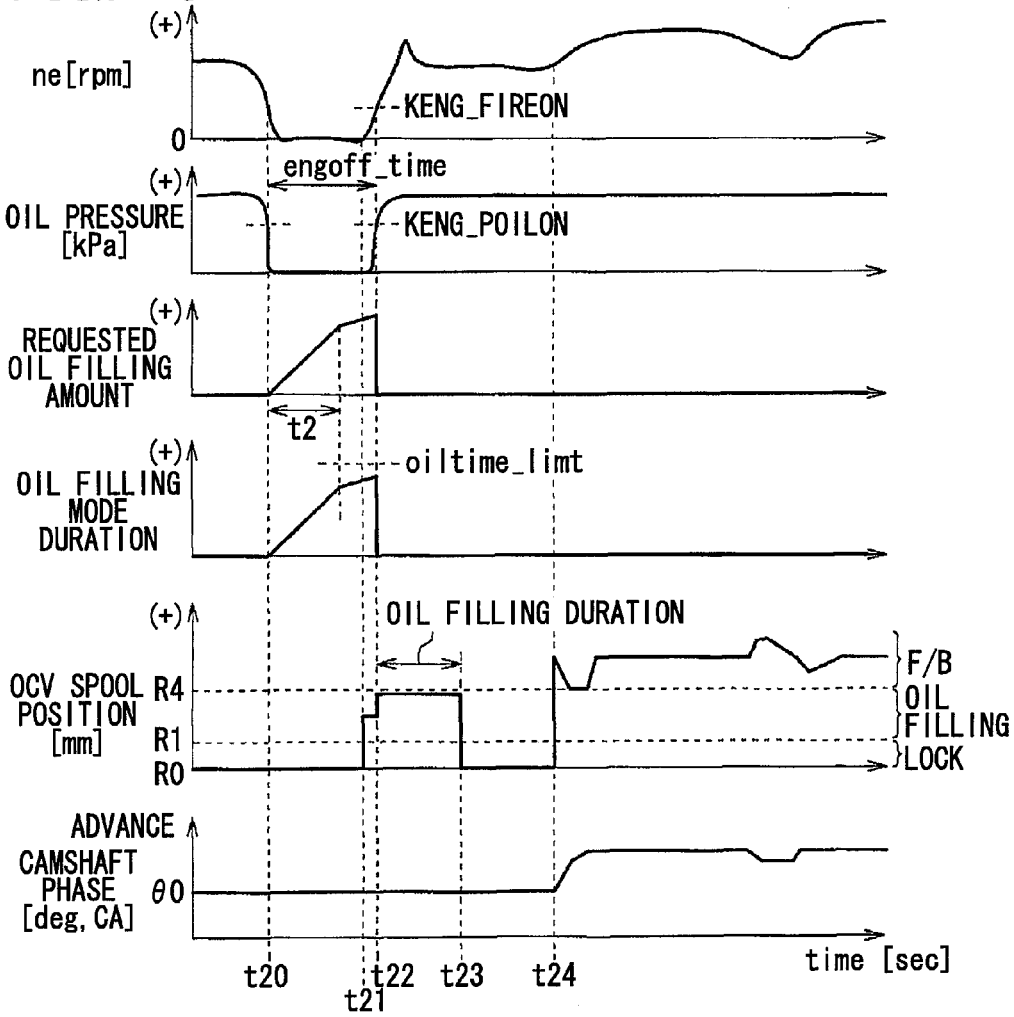
FIG. 15 is a time chart showing a specific aspect in a lock filling mode of the second embodiment.
Figure 16:
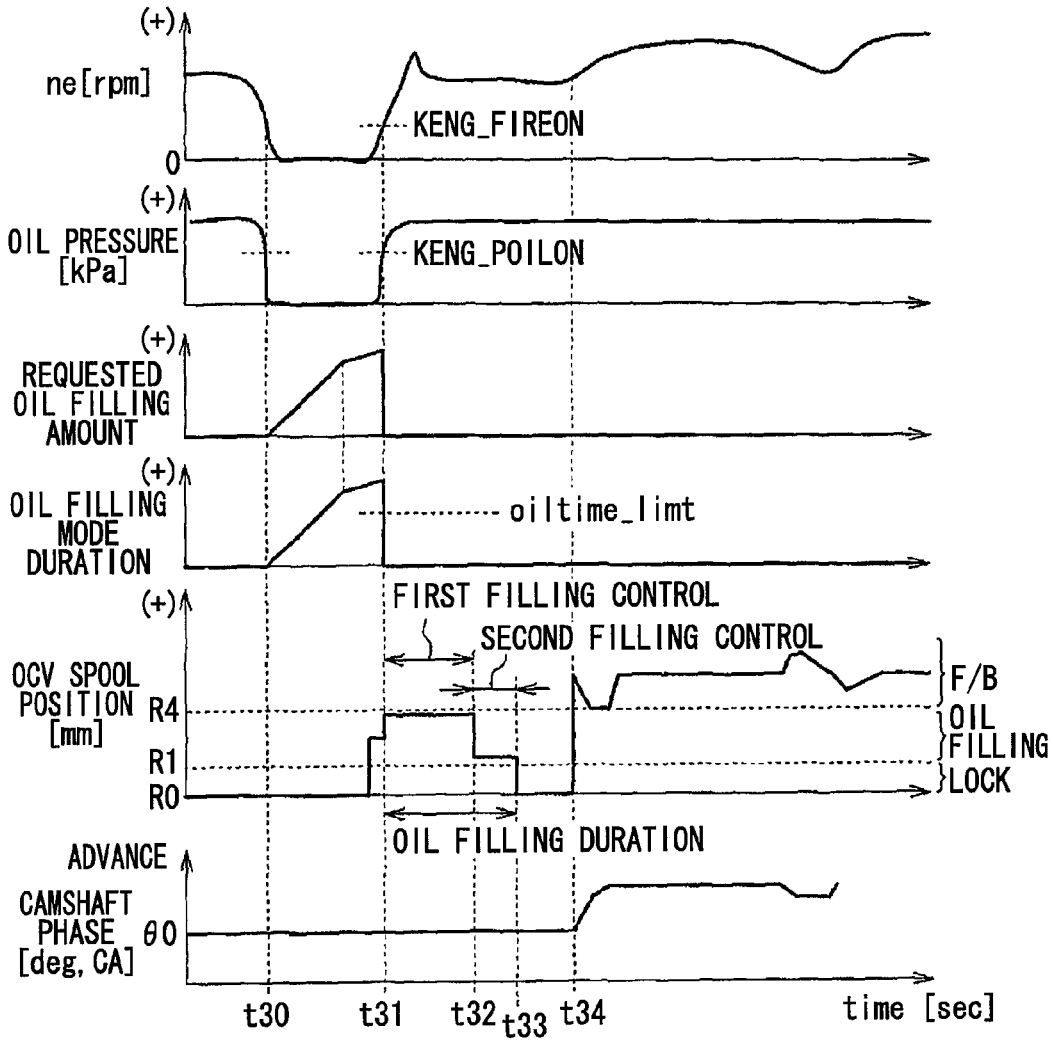
FIG. 16 is a time chart showing a specific aspect in the lock filling mode of the second embodiment.

A specific aspect of the OCV spool position control of the present embodiment will be described using FIGS. 14 to 16. FIG. 14 is a target position setting map of the present embodiment. FIG. 15 is a time chart showing a case where the filling mode requested duration oiltime is shorter than the pin erroneous release threshold oiltime_limt. FIG. 16 is a time chart showing a case where the filling mode requested duration oiltime is longer than the pin erroneous release threshold oiltime_limt. It is to be noted that in FIGS. 15 and 16, it is assumed that automatic stopping and restarting of the engine are performed.

As shown in FIG. 14, he target position setting map of the present embodiment includes a first filling control map M1 in which the spool control target position is set in the F/B-side regions Rf2, Rf3, and a second filling control map M2 in which the spool control target position is set in the lock-side region Rf1. In both of these two maps, the spool control target position is set in accordance with the oil temperature, and the higher the oil temperature, the closer the spool control target position is set to the lock mode side.

In FIG. 15, the engine speed decreases with automatic stopping of the engine 11, and when the oil pressure opoil is a threshold or lower (e.g., the oil pressure increase completion threshold KENG_POILON or lower), at that time t20, counting-up of the engine stop duration engoff_time is started. It should be noted that the oil inside the vane housing chamber 30 quickly flows out of the vane housing chamber 30 until its amount reaches a predetermined amount, and the oil then flows slowly (see FIG. 10). Accordingly, inclinations of changes in the requested oil filling amount qoil and the filling mode requested duration oiltime are large until time t2 elapses from a time t20, and after the lapse of the time t2, the inclinations of the changes become small.

When a restart request for the engine 11 is generated at a time t21, combustion of the engine 11 is resumed while clanking of the engine 11 is performed by the starter. Further, at the time t21, the spool control target position is set in the intermediate position KOCV2_BASE. Subsequently, at a time t22 when the engine speed ne increases and the oil pressure opoil reaches the oil pressure increase completion threshold KENG_POILON or higher, the spool control target position is changed to a target position ocv_tgt_h calculated using the first filling control map M1. Further, at the time t22, counting-up of the oil filling duration oiltimer is started.

Then, at a time t23 when the oil filling duration oiltimer becomes the filling mode requested duration oiltime, the oil filling mode is completed. When an execution condition for the F/B control mode has not been met at the point in time of completion of the oil filling mode, as shown in FIG. 15, the spool position is once controlled to the lock-side region Rf1 at the time t23, and a shift is made to the F/B control mode at a time t24 when the execution condition for the F/B control mode is met. The execution condition in the F/B control mode includes, for example, that the engine speed ne is an idling speed ne_idl or higher.

Next, a description will be given of a case where the filling mode requested duration oiltime at the time of setting the spool control target position in the F/B-side regions Rf2, Rf3 is longer than the pin erroneous release threshold oiltime_limt. In FIG. 16, at a time t30 when the oil pressure opoil falls to the threshold or lower after automatic stopping of the engine 11, counting-up of the engine stop duration engoff_time is started similarly to FIG. 15. Subsequently, when combustion of the engine 11 is resumed with the restart request for the engine 11 and the oil pressure opoil reaches the oil pressure increase completion threshold KENG_POILON or higher, the spool control target position is changed to the target position ocv_tgt_h calculated using the first filling control map M1 (t31). Then, the spool position control in the target position ocv_tgt_h is performed in a period until the time corresponding to the pin erroneous release threshold oiltime_limt elapses (in a period between t31 to t32). It is to be noted that the period from t31 to t32 corresponds to the filling start period.

Further, after the pin erroneous release threshold oiltime_limt elapses from a time t31, the spool control target position is changed to a target position ocv_tgt_l calculated using the second filling control map M2 (t32). Accordingly, the target position is changed to the lock-side region Rf1, and outflow of the oil from the lock release chamber 45 is permitted. Thereafter, at a time t33 when the oil filling duration oiltimer becomes the filling mode requested duration oiltime, the oil filling mode is completed. At a time t34 when the execution condition for the F/B control mode is met, a shift is made to the F/B control mode.

Figure 17:
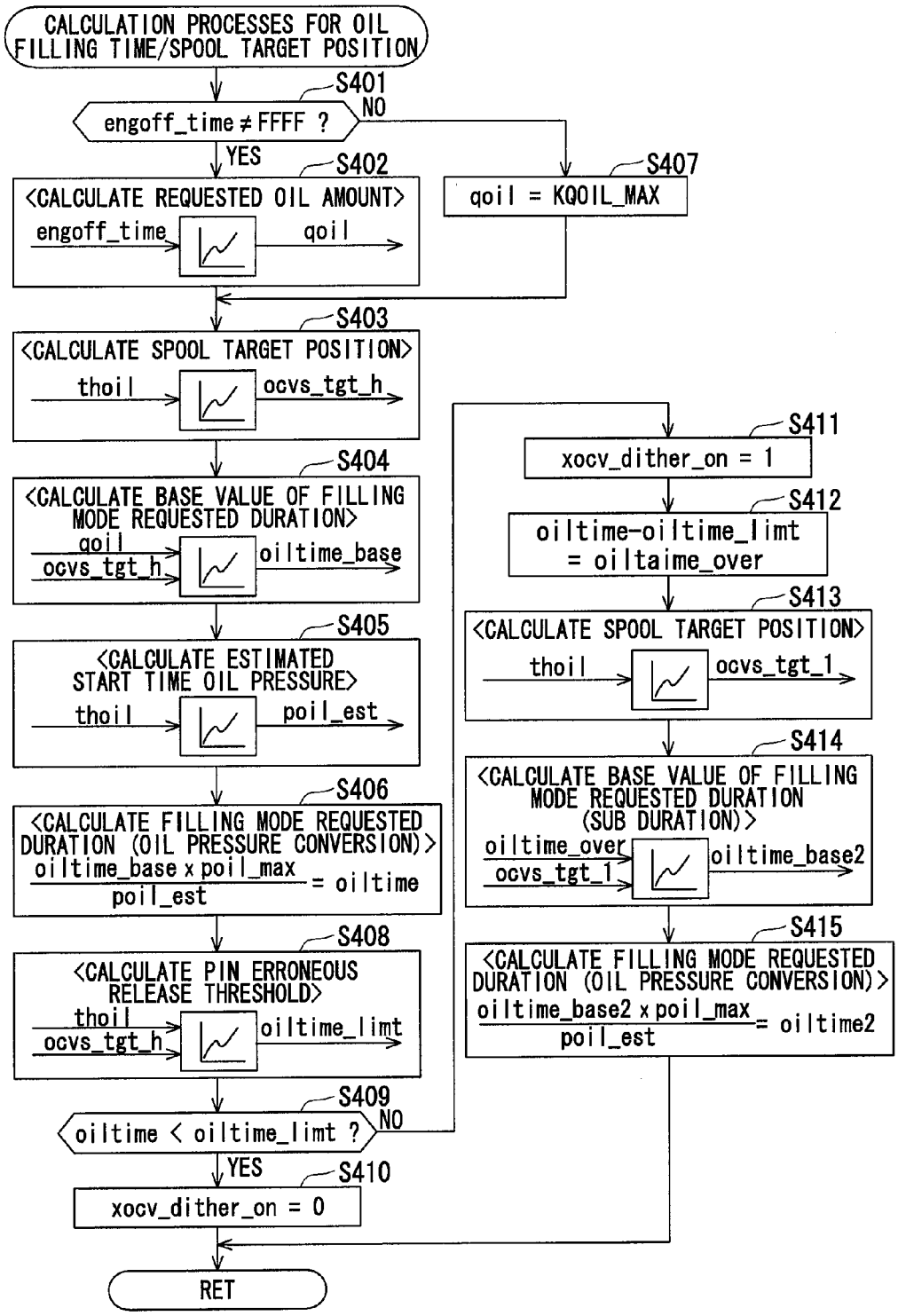
FIG. 17 is a flowchart showing a process procedure of calculation processes for oil filling time and a spool target position of the second embodiment.
Figure 18:
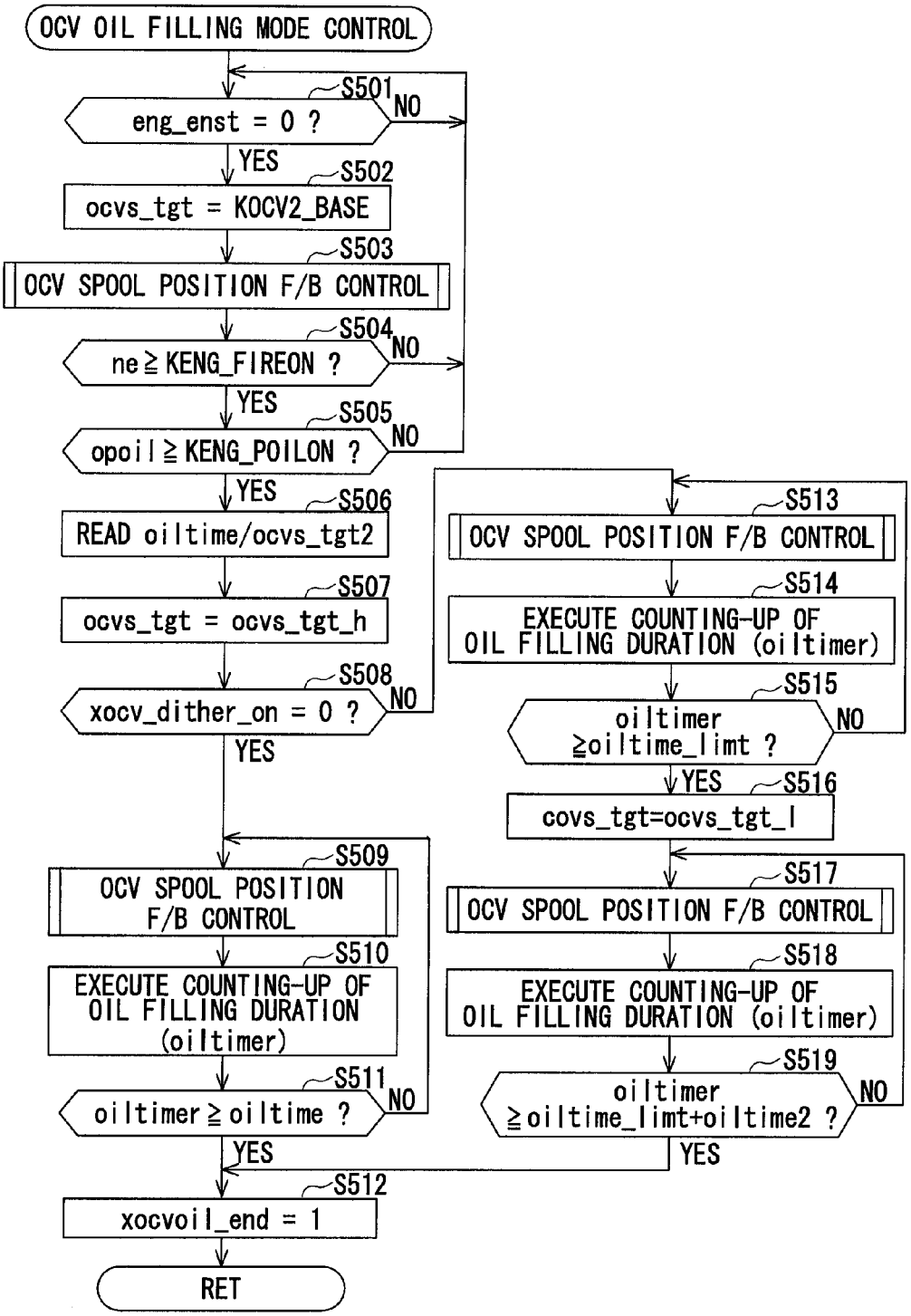
FIG. 18 is a flowchart showing a process procedure of OCV oil filling mode control of the second embodiment.

Next, the OCV spool position control of the present embodiment will be described using flowcharts of FIGS. 17 and 18. FIG. 17 is a flowchart showing a process procedure of calculation processes for the oil filling time and the spool target position. FIG. 18 is a flowchart showing the process procedure of the OCV oil filling mode control. The main routine of engine control is the same as in FIG. 11, and hence its description will be omitted here. In descriptions of FIGS. 17 and 18, the same processes as in FIGS. 12 and 13 are provided with the same step numbers as in FIGS. 12 and 13, and descriptions thereof will be omitted.

First, the calculation processes for the oil filling time and the spool target position of FIG. 17 will be described. In FIG. 17, the same processes as in Step S201 to S207 of FIG. 12 are performed in Step S401 to S407. However, in Step S403, a temperature dependent spool target ocvs_tgt_h is set using the first filling control map M1 of FIG. 14 in place of the map of FIG. 6.

After the filling mode requested duration oiltime has been calculated in Step S406, the process proceeds to Step S408. The oil temperature thoil and the temperature dependent spool target ocvs_tgt_h are inputted and the pin erroneous release threshold oiltime_limt is calculated based on these values. In the present embodiment, a map associating the oil temperature thoil, the target position ocvs_tgt_h, and the pin erroneous release threshold oiltime_limt with one another (e.g., map of FIG. 8B) is previously stored, and the pin erroneous release threshold oiltime_limt is calculated using this map. According to the map, the higher the oil temperature thoil is, or the closer the target position ocvs_tgt_h is to the F/B control mode side, the shorter time the pin erroneous release threshold oiltime_limt is set to.

In Step S409, the filling mode requested duration oiltime calculated in Step S406 and the pin erroneous release threshold oiltime_limt calculated in Step S408 are read, and it is determined whether or not the filling mode requested duration oiltime is shorter than the pin erroneous release threshold oiltime_limt. When "oiltime<oiltime_limt", the process proceeds to Step S410, and "0" is set for a pin erroneous release determination flag xocv_dither_on. On the other hand, when "oiltime oiltime_limt", the process proceeds to Step S411, and 1 is set for the pin erroneous release determination flag xocv_dither_on.

In subsequent Step S412, time exceeding the pin erroneous release threshold oiltime_limt out of the filling mode requested duration oiltime (=oiltime−oiltime_limt) is calculated, and this is set for sub filling time oiltime_over. Then in Step S413, a temperature dependent spool target position ocvs_tgt_l is calculated using the second filling control map M2 based on the oil temperature thoil detected by the oil temperature sensor 63.

In Step S414, the sub filling time oiltime_over and the target position ocvs_tgt_l are inputted, and a base value oiltime_base2 of the filling mode requested sub duration is calculated based on these values. Herein the base value oiltime_base2 is calculated using a map associating the sub filling time oiltime_over, the target position ocvs_tgt_l, and the base value oiltime_base2 with one another. In this map, the longer the sub filling time oiltime_over, or the closer the target position ocvs_tgt_l is to the lock mode side, the larger value the base value oiltime_base2 of the filling mode requested sub duration is set to.

In subsequent Step S415, the base value oiltime_base2 of the filling mode requested sub duration is subjected to oil pressure conversion, to calculate the filling mode requested sub duration oiltime2. The filling mode requested sub duration oiltime2 is calculated by the following formula (2). Subsequently, the process is completed.

$$(\text{oiltime_base2} \times \text{poil_max})/(\text{poil_est}) = \text{oiltime2} \quad (2)$$

Next, the process procedure of the oil filling mode control of FIG. 18 will be described. In FIG. 18, the same processes as in Steps S301 to S305 of FIG. 13 are executed in Steps S501 to S505, and in Step S506, the filling mode requested duration oiltime and the temperature dependent spool target ocvs_tgt_h calculated by the first filling control map M1 are read. In subsequent Step S507, the spool control target position ocvs_tgt is changed to the target position ocvs_tgt_h calculated from the intermediate position KOCV2_BASE based on the oil temperature.

In Step S508, it is determined whether or not "0" has been set for the pin erroneous release determination flag xocv_dither_on, and when "xocv_dither_on=0", processes of Steps S509 to S512 are executed. The processes of Steps S509 to S512 are the same processes as those of Steps S308 to S311 of FIG. 13.

On the other hand, when "xocv_ditheron=1", the process proceeds to Step S513, and the F/B control is executed based on the spool control target position ocvs_tgt. Accordingly, the OCV spool position is controlled to the target position ocvs_tgt_h calculated based on the first filling control map M1. Further, in Step S514, counting-up of the oil filling duration oiltimer is executed.

In subsequent Step S515, it is determined whether or not the oil filling duration oiltimer has reached the pin erroneous release threshold oiltime_limt or longer. When "oiltimer<oiltime_limt", the F/B control for the OCV spool position is performed with the spool control target position ocvs_tgt being the same as ocvs_tgt_h. Then, when "oiltimer oiltime_limt" is determined, a positive determination is made in Step S515, and the process proceeds to S516. The spool control target position ocvs_tgt is changed to the target position ocvs_tgt_l calculated by the second filling control map M2. Further, in Step S517, the F/B control is executed based on the spool control target position ocvs_tgt_l.

In Step S518, counting-up of the oil filling duration oiltimer is executed. When the oil filling duration oiltimer is a duration, obtained by adding up the pin erroneous release threshold oiltime_limt and the filling mode requested sub duration oiltime2, or longer, a positive determination is made in Step S519, and the process proceeds to Step S512 in which 1 is set for the oil filling completion flag xocvoil_end, and then the process completes the routine.

In the second embodiment as detailed above, it has been configured that the requested oil filling amount qoil is calculated as the requested value of the oil supplied to the advancement chamber 35 and the retardation chamber 36 by the oil filling mode, and the spool control target position ocvs_tgt is calculated based on the requested oil filling amount qoil. From the viewpoint of reducing the time for oil filling of the advancement chamber 35 and the retardation chamber 36, it is desirable to control the spool position in a place where the amount of the oil supplied to the advancement chamber 35 is as large as possible. On the other hand, when the requested oil filling amount qoil is large, the filling mode requested duration oiltime becomes long and the oil filling duration oiltimer may exceed the pin erroneous release threshold oiltime_limt. In view of this respect, with the above configuration, it is possible to complete the oil filling of the advancement chamber 35 and the retardation chamber 36 before occurrence of the lock erroneous release.

It has been configured that, when the filling mode requested duration oiltime at the time of setting the spool control target position in the F/B-side regions Rf2, Rf3 is longer than the pin erroneous release threshold oiltime_limt, first, the oil filling is performed in the target position ocv_tgt_h calculated using the first filling control map M1, and thereafter, the target position is changed to the target position ocv_tgt_l calculated using the second filling control map M2 after a lapse of the time corresponding to the pin erroneous release threshold oiltime_limt. With this configuration, while the oil filling is performed in the spool position where the amount of the oil supplied to the advancement chamber 35 is as large as possible, outflow of the oil from the lock release chamber 45 can be permitted before occurrence of the erroneous release of the lock pin 42. Hence it is possible to reduce the time required for the oil filling of the advancement chamber 35 and the retardation chamber 36, while avoiding the erroneous release of the lock pin 42.

Other Embodiments

The present disclosure is not restricted to the descriptions of the above embodiments, but may be performed in such a manner as follows.

In the above second embodiment, it has been configured that, when the filling mode requested duration oiltime in the case of assuming that the spool control target position is held in the F/B-side regions Rf2, Rf3 is longer than the pin erroneous release threshold oiltime_limt, the first filling control of setting the spool control target position in the F/B-side regions Rf2, Rf3 is performed in the filling start period until the oil filling duration oiltimer exceeds the pin erroneous release threshold oiltime_limt, and the second filling control of setting the spool control target position in the lock-side region Rf1 is performed after a lapse of the filling start period. In contrast, in the present embodiment, it is configured that, when the filling mode requested duration oiltime in the case of assuming that the spool control target position is held in the F/B-side regions Rf2, Rf3 is longer than the pin erroneous release threshold oiltime_limt, the first filling control and the second filling control are alternately switched and performed. Also in this case, while the oil filling is performed in the spool position where the amount of the oil supplied to the advancement chamber 35 is as large as possible, outflow of the oil from the lock release chamber 45 can be permitted before occurrence of the erroneous release of the lock pin 42. Hence it is possible to reduce the time required for the oil filling of the advancement chamber 35 and the retardation chamber 36, while avoiding the erroneous release of the lock pin 42.

Figure 19:
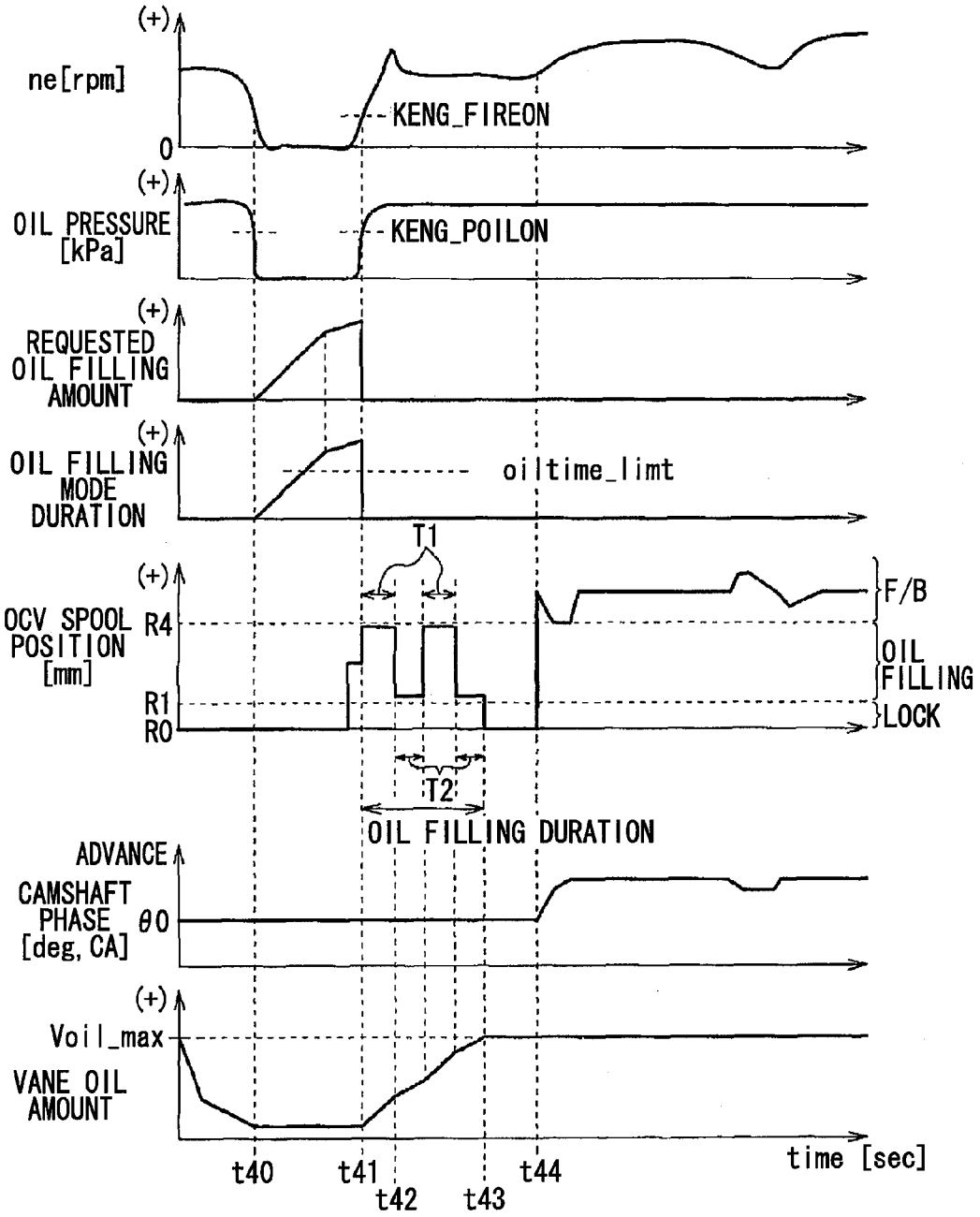
FIG. 19 is a time chart showing a specific aspect in a lock filling mode of another embodiment.

FIG. 19 is a time chart showing a specific aspect of the OCV spool position control of the present embodiment. FIG. 19 shows a case where the filling mode requested duration oiltime at the time of setting the spool control target position in the F/B-side regions Rf2, Rf3 is longer than the pin erroneous release threshold oiltime_limt. In FIG. 19, at a time t40 when the oil pressure opoil falls to the threshold or lower after automatic stopping of the engine 11, counting-up of the engine stop duration engoff_time is started. Subsequently, when the engine 11 is restarted and the oil pressure opoil reaches the oil pressure increase completion threshold KENG_POILON or higher, the spool control target position is changed to the target position ocv_tgt_h calculated using the first filling control map M1 (t41). Further, the spool position control in the target position ocv_tgt_h is performed in a period until predetermined filling main time T1 which is shorter than the pin erroneous release threshold oiltime_limt elapses. After the predetermined filling main time T1 elapses from the time T41, the spool control target position is changed to the target position ocv_tgt_l calculated using the second filling control map M2 (t42), and the spool position control in the target position ocv_tgt_l is performed in a period until predetermined sub filling time T2 elapses. Thereafter, the spool position control is performed by alternately switching the spool control target position between ocv_tgt_h and ocv_tgt_l. The spool position control is performed such that a total of the time when the spool control target position is ocv_tgt_h is the pin erroneous release threshold oiltime_limt, and that a total of the time when the spool control target position is ocv_tgt_l is the filling mode requested sub duration oiltime2.

Figure 20:
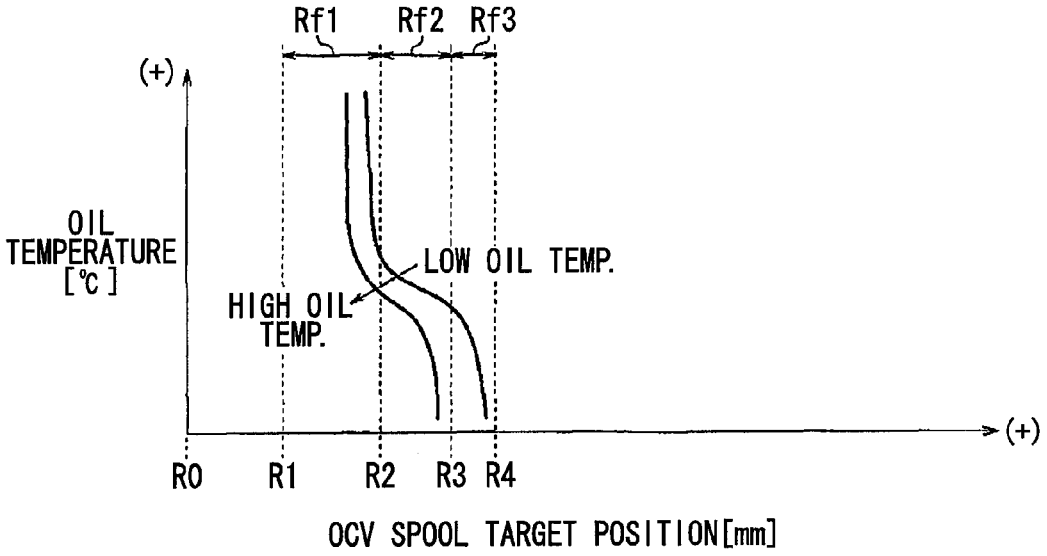
FIG. 20 is a chart showing one example of a map associating an oil temperature, oil pressure, and a spool control target position with one another.

It may also be configured that a pressure sensor as a pressure detection device for detecting pressure of the hydraulic oil is provided, and based on oil pressure detected by the pressure sensor and oil viscosity (oil temperature, etc.), the spool control target position on the oil filling mode is set variable. The possibility for oil leakage inside the OCV 20 also varies in accordance with oil pressure. The higher the oil pressure, the more the oil leakage inside the OCV 20 is apt to occur. In view of such a respect, in the present embodiment, oil pressure is considered at the time of setting the spool control target position. For example, as shown in FIG. 20, a plurality of maps in accordance with oil pressure are stored, and the spool control target position is set using the map. Alternatively, the spool control target position calculated using the map of FIG. 6 may be multiplied by a correction coefficient kp in accordance with oil pressure. In this case, the correction coefficient kp is set such that the higher the oil pressure, the closer the target position is to the lock mode side.

As the configuration for changing the spool control target position based on the oil temperature and the requested oil filling amount qoil, there may be formed a configuration where the larger the requested oil filling amount qoil, the closer the spool control target position is set to the F/B control mode side. For example, a map associating the oil temperature, the requested oil filling amount qoil, and the spool control target position with one another is previously stored, and by use of the map, the spool control target position corresponding to the oil temperature and the requested oil filling amount qoil at this engine start-up is set.

In the above embodiment, it has been configured that the oil temperature sensor 63 as the temperature detection device for detecting an oil temperature is provided as a device for detecting oil viscosity, and that the spool control target position is set based on a detected value of the sensor 63. The temperature detection device is not restricted to the oil temperature sensor 63, but it may be configured that an oil temperature is estimated based on a detected value of the cooling water temperature sensor 64, for example.

In the above embodiment, the spool control target position has been set based on the oil temperature, but oil viscosity may be directly detected and the spool control target position may be set using the detected value. Alternatively, the spool control target position may be set based on a parameter (e.g., oil type, etc.) correlated with the oil viscosity, other than the oil temperature.

In the second embodiment, it has been configured that, when the filling mode requested duration oiltime in the case of assuming the spool control target position being held in the F/B-side regions Rf2, Rf3 is longer than the pin erroneous release threshold oiltime_limt, setting of the spool control target position in the F/B-side regions Rf2, Rf3 is completed by changing the spool control target position to the lock-side region Rf1 before the oil filling duration oiltimer reaches the pin erroneous release threshold oiltime_limt. In contrast, in the present embodiment, it is configured that setting of the spool control target position in the F/B-side regions Rf2, Rf3 is completed by changing the spool control target position to the lock region Rt before the oil filling duration oiltimer reaches the pin erroneous release threshold oiltime_limt. Also in this case, it is possible to open the outflow passage for the oil from the lock release chamber 45, and avoid the lock erroneous release even if oil leakage occurs inside the OCV 20.

In the above embodiment, it has been configured that, after starting of clanking, the spool control target position is set in the intermediate position KOCV2_BASE until the oil pressure opoil reaches the oil pressure increase completion threshold KENG_POILON or higher, and that the spool control target position changes to a target position in accordance with an oil temperature after the oil pressure opoil reaches the oil pressure increase completion threshold KENG_POILON or higher. However, it may be configured that the spool control target position is set in the intermediate position KOCV2_BASE at all times during stopping of the engine, or it may be configured that the spool control target position is set in a target position in accordance with an oil temperature immediately after starting of clanking.

In the above second embodiment, it has been configured that the first filling control map M1 and the second filling control map M2 are provided as the target position setting maps, but only the first filling control map M1 may be previously stored, and the target position ocvs_tgt_l of the second filling control may be a value obtained by displacing the target position ocvs_tgt_h calculated from the first filling control map M1 to the lock mode side by a predetermined amount. The predetermined amount at this time may be constant or made variable in accordance with an oil temperature and a requested oil filling amount. Conversely, only the second filling control map M2 may be previously stored, and the target position ocvs_tgt_h of the first filling control may be a value obtained by displacing the target position ocvs_tgt_l calculated from the second filling control map M2 to the F/B control mode side by a predetermined amount.

In the above embodiment, the control region of the oil filling mode is a region from the position R1 to the position R4, but it may be configured that the region Rf3 after coupling of the lock release port 26*e* and the sub supply port 26*d* is not included in the control region for the oil filling mode, and that the target position is set within the region from the position R1 to the position R3.

In the above embodiment, it has been configured that the control mode is switched in order of the lock mode, the oil filling mode, the advancement mode, the hold mode, and the retardation mode with increase in control duty of the OCV 20, but it may be configured that the control mode is switched in order of the retardation mode, the hold mode, the advancement mode, the oil filling mode, and the lock mode with increase in control duty of the OCV 20.

In the oil filling mode, the advancement chamber 35 and the retardation chamber 36 are filled with the oil by opening the oil supply passage to the advancement chamber 35, but it may be configured that the advancement chamber 35 and the retardation chamber are filled with the oil by opening the oil supply passage to the retardation chamber 36. In this case, the control mode may be switched in order of the lock mode, the oil filling mode, the retardation mode, the hold mode, and the advancement mode.

In the above embodiment, the description has been given of the case where application is made to the configuration where the OCV 20 is provided inside the valve timing adjustment device 18 and is integrated with the valve timing adjustment device 18, but application may be made to a configuration where the OCV 20 and the valve timing adjustment device 18 are separated from each other.

The valve timing adjustment device 18 has been provided on the intake-side camshaft 16, but the valve timing adjustment device may be provided on the exhaust-side camshaft 17 and similar OCV spool position control to the above may be performed.

Although the present disclosure has been described in conformity to the embodiments, it is understood that the present disclosure is not restricted to the embodiments and the structures. The present disclosure includes a variety of modified examples and modification within an equivalent range. In addition, a variety of combinations and forms, and further, other combinations and forms obtained by including only one element or more than or less than one element in the variety of combinations and forms, are within a scope and thought range of the present disclosure.

The invention claimed is:

1. A valve timing control device of an internal combustion engine, the device comprising:

a timing adjustment device that changes a rotation phase of a camshaft with respect to a crank shaft by adjustment of inflow and outflow of hydraulic oil to and from an advancement chamber and a retardation chamber, to adjust valve timing;

a lock pin that moves by adjustment of inflow and outflow of the hydraulic oil to and from an oil pressure chamber, to lock the rotation phase in an intermediate phase between the most advanced phase and the most retarded phase; and an oil pressure adjustment valve that adjusts inflow and outflow of the hydraulic oil to and from the advancement chamber, the retardation chamber, and the oil pressure chamber by reciprocation of a spool in a shaft direction, wherein the lock pin moves in a lock releasing direction by inflow of the hydraulic oil to the oil pressure chamber, and moves in a locking direction by outflow of the hydraulic oil from the oil pressure chamber, a first region, a second region, and a third region are aligned in this order in the shaft direction of the spool as regions in which the spool moves, and the valve timing control device includes:

a mode selection device that selects as a control mode any of a lock mode for setting a target position of the spool within the first region to move the lock pin in the locking direction, a phase control mode for setting the target position within the third region to control the rotation phase by a target phase in accordance with an operation state of the internal combustion engine, and an oil filling mode for setting the target position within the second region before a shift is made from the lock mode to the phase control mode, to fill the advancement chamber and the retardation chamber with the hydraulic oil in a state where the lock pin moves in the locking direction; and a position control device that sets the target position based on viscosity of the hydraulic oil, and controls a position of the spool so as to be the set target position when the mode selection device selects the oil filling mode as the control mode.

2. The valve timing control device of the internal combustion engine according to claim 1, the device comprising, as a device for detecting the viscosity of the hydraulic oil, a temperature detection device that detects a temperature of the hydraulic oil, wherein the position control device sets the target position based on the temperature detected by the temperature detection device.

3. The valve timing control device of the internal combustion engine according to claim 1, wherein the second region includes an outflow permitted region which is set on the first region side and in which an outflow passage for the hydraulic oil from the oil pressure chamber is opened, and an outflow prohibited region which is set on the third region side and in which the outflow passage is blocked, and a amount of the hydraulic oil supplied to the advancement chamber and the retardation chamber is larger in the outflow prohibited region than in the outflow permitted region, and the position control device sets the target position to be closer to the third region side within the second region when the viscosity of the hydraulic oil is higher.

4. The valve timing control device of the internal combustion engine according to claim 1, the device comprising a filling amount calculation device that calculates a requested oil filling amount which is a requested value of the hydraulic oil to be supplied to the advancement chamber and the retardation chamber in the oil filling mode, wherein the position control device sets the target position based on the requested oil filling amount calculated by the filling amount calculation device.

5. The valve timing control device of the internal combustion engine according to claim 4, wherein the second region includes the outflow permitted region which is on the first region side and in which an outflow passage for the hydraulic oil from the oil pressure chamber is opened, and the outflow prohibited region which is on the third region side and in which the outflow passage is blocked, and a amount of the hydraulic oil supplied to the advancement chamber and the retardation chamber is larger in the outflow prohibited region than in the outflow permitted region, the valve timing control device includes:

a time calculation device that calculates requested duration which is a requested value of duration of the oil filling mode when the target position is set within the outflow prohibited region based on the requested oil filling amount calculated by the filling amount calculation device; and an erroneous release determination device that determines whether or not the requested duration calculated by the time calculation device is longer than a pin erroneous release threshold which is a threshold of time when a concern about erroneous release of the lock pin is generated, and when the erroneous release determination device determines that the requested duration is longer than the pin erroneous release threshold, the position control device completes setting of the target position within the outflow prohibited region before the duration reaches the pin erroneous release threshold.

6. The valve timing control device of the internal combustion engine according to claim 5, wherein first filling control of controlling the position of the spool by setting the target position within the outflow prohibited region and second filling control of controlling the position of the spool by setting the target position within the outflow permitted region are performed as the oil filling mode, and the position control device performs filling with the hydraulic oil by the first filling control when the erroneous release determination device determines that the requested duration is shorter than the pin erroneous release threshold, and the position control device performs filling with the hydraulic oil by the first filling control and the second filling control when the erroneous release determination device determines that the requested duration is longer than the pin erroneous release threshold.

7. The valve timing control device of the internal combustion engine according to claim 6, wherein, when the erroneous release determination device determines that the requested duration is longer than the pin erroneous release threshold, the position control device performs the first filling control in a predetermined filling start period before the duration reaches the pin erroneous release threshold, and the position control device makes a switch to the second filling control after a lapse of the predetermined filling start period.

8. The valve timing control device of the internal combustion engine according to claim 6, wherein, when the erroneous release determination device determines that the requested duration is longer than the pin erroneous release threshold, the position control device alternately switches and performs the first filling control and the second filling control.

9. The valve timing control device of the internal combustion engine according to claim 1, the device comprising a pressure detection device that detects a voltage of the hydraulic oil, wherein the position control device sets the target position based on the viscosity of the hydraulic oil and the pressure detected by the pressure detection device.

* * * * *